United States Patent [19]

Kotabe et al.

[11] Patent Number: 5,034,780

[45] Date of Patent: Jul. 23, 1991

[54] IMAGE FORMING APPARATUS

[75] Inventors: Hiroaki Kotabe, Funabashi; Yasushi Nakazato, Tokyo, both of Japan

[73] Assignee: Ricoh Company, Ltd., Tokyo, Japan

[21] Appl. No.: 412,286

[22] Filed: Sep. 25, 1989

[30] Foreign Application Priority Data

Sep. 30, 1988 [JP] Japan ..... 63-246874

[51] Int. Cl.[5] ..... G03G 21/00

[52] U.S. Cl. ..... 355/316; 271/258; 271/259; 355/206; 355/209; 355/311; 355/321

[58] Field of Search ..... 355/308, 309, 203–206, 355/311, 316, 321, 207–209, 313, 323; 271/256, 258, 259

[56] References Cited

U.S. PATENT DOCUMENTS

| | | | |
|---|---|---|---|
| 4,176,941 | 12/1979 | Breitenkam et al. | 355/206 |
| 4,306,803 | 12/1981 | Donohue et al. | 355/204 |
| 4,477,178 | 10/1984 | Furuichi et al. | 355/206 |
| 4,511,241 | 4/1985 | Tsudaka et al. | 355/206 X |
| 4,521,102 | 6/1985 | Motomura et al. | 355/316 X |
| 4,530,063 | 7/1985 | Masuda et al. | 355/206 X |
| 4,627,711 | 12/1986 | Schron | 355/316 X |
| 4,655,582 | 4/1987 | Okuda et al. | 355/206 X |
| 4,855,754 | 8/1989 | Tanaka et al. | 355/206 X |
| 4,860,055 | 8/1989 | Ohira et al. | 355/209 X |
| 4,908,655 | 3/1990 | Takagi | 355/209 X |
| 4,952,988 | 8/1990 | Furuichi et al. | 355/209 |

FOREIGN PATENT DOCUMENTS

| | | | |
|---|---|---|---|
| 0105248 | 6/1983 | Japan | 355/316 |
| 0123558 | 7/1983 | Japan | 355/208 |
| 0230163 | 11/1985 | Japan | 355/207 |
| 0278873 | 12/1986 | Japan | 355/206 |
| 0130171 | 5/1989 | Japan | 355/309 |

*Primary Examiner*—A. T. Grimley
*Assistant Examiner*—Matthew S. Smith
*Attorney, Agent, or Firm*—Cooper & Dunham

[57] ABSTRACT

An image forming apparatus is provided with sensors for detecting existence of sheets of paper at a plurality of positions in transport paths within the image forming apparatus. A circuit part counts a number of sheets of paper remaining within the image forming apparatus when a transport abnormality occurs based on outputs of the sensors. This number of sheets of paper remaining within the image forming apparatus when the transport abnormality occurs is displayed on a display.

12 Claims, 17 Drawing Sheets

FIG.5
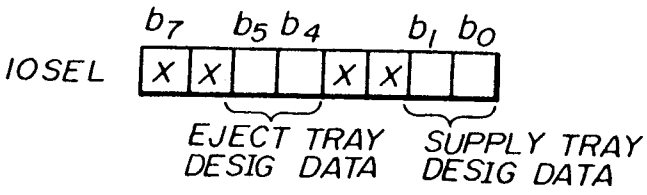
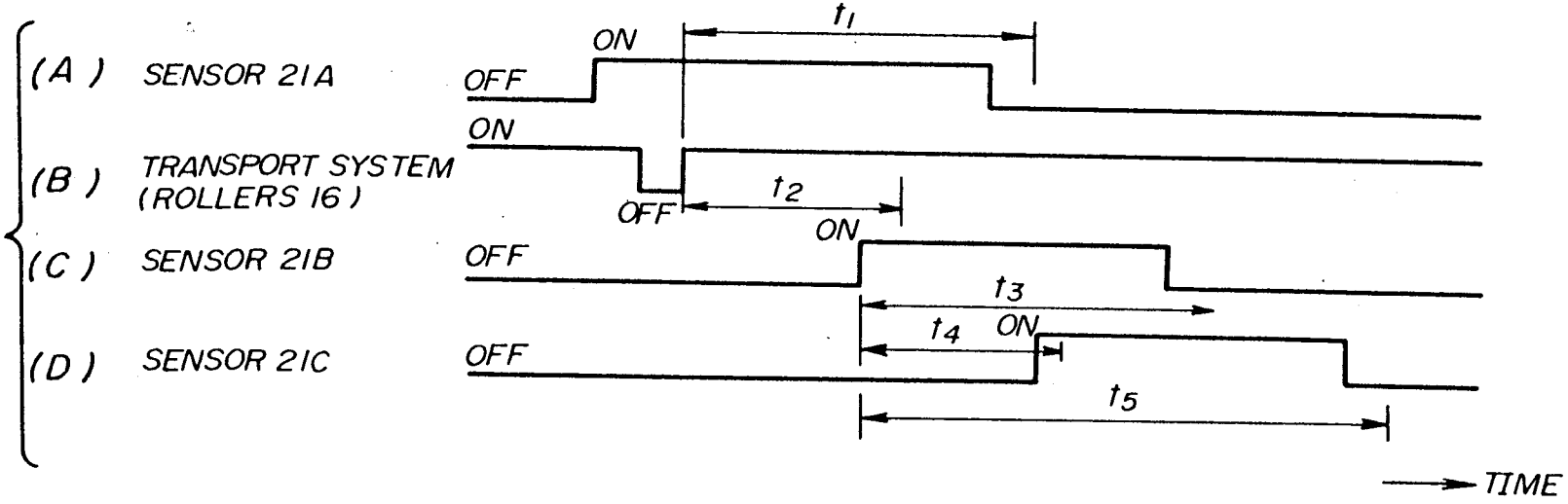
FIG.6

IMAGE FORMING APPARATUS

BACKGROUND OF THE INVENTION

The present invention generally relates to image forming apparatuses, and more particularly to an image forming apparatus which is provided with a means for detecting a transport abnormality (paper jam) in a paper transport path and for stopping a sequential operation of image formation.

Generally, in image forming apparatuses such as printers including laser printers, copying machines and facsimile machines, a sequence control part which uses a microcomputer controls the sequential operation of the image formation. In addition, a plurality of paper transport paths are provided in the image forming apparatus to supply the paper and to eject the paper after the image formation.

A sensor is arranged in each paper transport path and functions as a paper detecting means for detecting the paper which passes through the paper transport path. Hence, while the sequential operation is controlled by the sequence control part, it is possible to detect a transport abnormality, that is, a paper jam, based on output signals of the sensors. When the paper jam is detected, the sequential operation is stopped by the sequence control part so as to stop the paper transport. In addition, a message indicating the generation of the paper jam is displayed on a display part which is provided on an outer side of a main apparatus body of the image forming apparatus. Among such image forming apparatuses, there are image forming apparatuses capable of also displaying the position where the paper jam is generated.

In order to restart the image forming apparatus the sequential operation of which is stopped by the generation of the paper jam, a front or side cover of the image forming apparatus is opened to remove all the papers causing the paper jam. Then, a reset button is pushed to make a reset operation which cancels both the stopped state of the sequential operation and the display on the display part. Alternatively, the reset operation may be made automatically when the front or side cover is closed.

However, according to the conventional image forming apparatus, it is impossible to know how many sheets of paper remain within the image forming apparatus when the paper transport is stopped by the generation of the paper jam. As a result, not all the sheets of paper within the image forming apparatus may be removed when eliminating the paper jam. For this reason, there is a problem in that it is often necessary to repeat the operation of removing the sheets of paper within the image forming apparatus when the paper jam occurs because not all the sheets of paper may be removed in one removing operation.

On the other hand, after the paper jam is eliminated, it is sometimes difficult to determine the page from which the printing, copying or facsimile transmission is to be resumed.

When the transport abnormality is generated at an ejecting part of the image forming apparatus, the paper transport is often stopped in a state where a tip end of the paper projects from a paper ejecting opening of the ejecting part. In this case, the paper causing the transport abnormality, that is, the paper jam, may be removed by simply pulling the tip end of the projecting paper in a paper ejecting direction. But in the conventional image forming apparatus, the front or side cover must be opened and closed or the reset button must be pushed in order to make the reset operation and restart the sequential operation of the image forming apparatus even though the paper jam is eliminated by the operation of simply pulling out the paper from the paper ejecting part. As a result, there are problems in that a troublesome operation must be carried out to restart the sequential operation and it takes time for the image forming apparatus to resume the sequential operation.

Furthermore, the stopped state of the sequential operation cannot be cancelled unless all the sheets of paper within the paper transport path are removed and the reset operation is made. This means that even when a certain transport path is usable when the paper jam occurs in another transport path, the certain transport path cannot be used for the image formation until the paper jam is eliminated and the reset operation is made. Therefore, in this case, there is a problem in that the efficiency of the image forming apparatus is poor.

SUMMARY OF THE INVENTION

Accordingly, it is a general object of the present invention to provide and novel and useful image forming apparatus in which the problems described above are eliminated.

Another and more specific object of the present invention is to provide an image forming apparatus comprising one or a plurality of paper supply means for supplying sheets of paper, image forming means for forming an image on a sheet of paper which is received from the paper supplying means, ejecting means for ejecting sheets of paper which have images formed thereon by the image forming means, one or a plurality of paper eject parts for receiving a sheet of paper which has an image formed thereon by the image forming means and is ejected by the ejecting means, a plurality of paper transport paths provided between the paper supply means and the image forming means, between the image forming means and the ejecting means and between the ejecting means and the paper eject parts, paper transport means for transporting the sheets of paper in the paper transport paths, sequence control means for controlling a sequential operation of the paper supply means, the paper transport means, the image forming means and the ejecting means, a plurality of paper detecting means for detecting an existance of paper at a plurality of positions in the paper transport paths, transport abnormality detecting means for detecting a transport abnormality during the sequential operation based on output signals of the plurality of paper detecting means, abnormality stop means for stopping the sequential operation when the transport abnormality is detected by the transport abnormality detecting means, remaining paper counting means for counting a number of sheets of paper remaining within the paper transport paths during the sequential operation, and remaining paper display means including a display for displaying the number of sheets of paper counted by the remaining paper counting means when the transport abnormality is detected by the transport abnormality detecting means. According to the image forming apparatus of the present invention, the operator is not only informed of the transport abnormality but is also informed of the number of sheets of paper remaining within the image forming apparatus, thereby making it possible to quickly and positively remove all the sheets of paper remaining within the image forming apparatus when the transport abnormality occurs.

Still another object of the present invention is to provide an image forming apparatus comprising one or a plurality of paper supply means for supplying sheets of paper, image forming means for forming an image on a sheet of paper which is received from the paper supplying means, ejecting means for ejecting sheets of paper which have images formed thereon by the image forming means, one or a plurality of paper eject parts for receiving a sheet of paper which has an image formed thereon by the image forming means and is ejected by the ejecting means, a plurality of paper transport paths provided between the paper supply means and the image forming means, between the image forming means and the ejecting means and between the ejecting means and the paper eject parts, paper transport means for transporting the sheets of paper in the paper transport paths, sequence control means for controlling a sequential operation of the paper supply means, the paper transport means, the image forming means and the ejecting means, a plurality of paper detecting means for detecting an existance of paper at a plurality of positions in the paper transport paths, transport abnormality detecting means for detecting a transport abnormality during the sequential operation based on output signals of the plurality of paper detecting means, abnormality stop means for stopping the sequential operation when the transport abnormality is detected by the transport abnormality detecting means, and stop cancelling means for cancelling a sequential operation stopping operation of the abnormality stop means when the output of the paper detecting means changes from a signal indicating an existence of a sheet of paper to a signal indicating a non-existence of a sheet of paper during a stopped state of the sequential operation. According to the image forming apparatus of the present invention, when the transport abnormality occurs in the paper eject part, for example, the sequential operation stopping operation is automatically cancelled by merely removing the sheet of paper remaining in the ejecting part, without the need to open and close a cover or to push a reset button. Therefore, the transport abnormality can be eliminated with a high efficiency.

A further object of the present invention is to provide an image forming apparatus of the above described second type wherein the stop cancelling means successively carries out a cancelling operation in response to the outputs of the plurality of paper detecting means in a sequence starting from the output of the paper detecting means which is arranged in a paper transport path located on a most downstream side out of the paper transport paths along a direction in which the sheets of paper are transported from the paper supply means to the ejecting means. According to the image forming apparatus of the present invention, the cancelling of the sequential operation stopping operation is carried out starting from the paper transport path which is located on the most downstream side, thereby making it possible to use the paper transport path which is located on the most downstream side for the image formation when the sequential operation stopping operation is carried out with respect to this paper transport path before the sequential operation stopping operation is cancelled for all the paper transport paths.

Other objects and further features of the present invention will be apparent from the following detailed description when read in conjunction with the accompanying drawings.

BRIEF DESCRIPTION OF THE DRAWINGS

FIG. 5 is a diagram for explaining a register in which data for designating a paper supply tray and a paper eject tray are set;

FIGS. 6(A) through 6(D) are timing charts for explaining an operation of the first embodiment;

DESCRIPTION OF THE PREFERRED EMBODIMENTS

Figure 1:
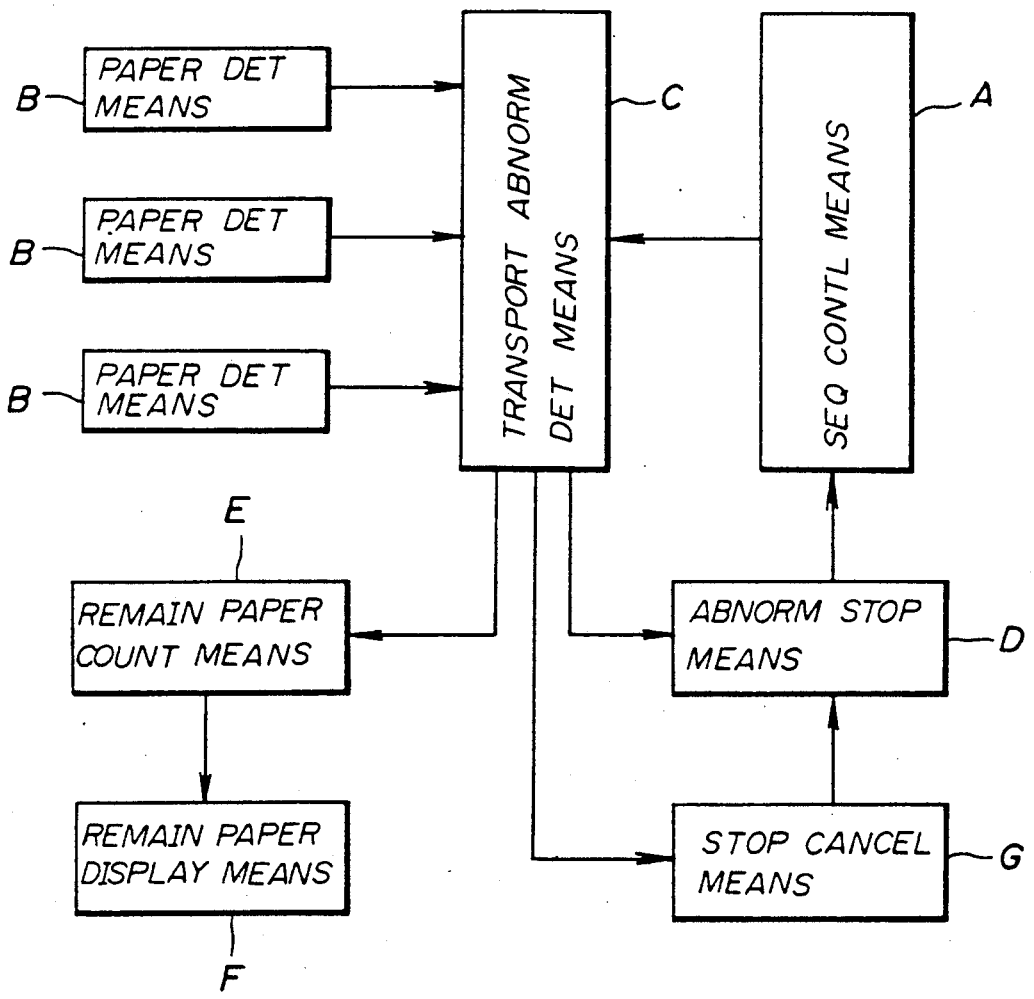
FIG. 1 is a system block diagram for explaining an operating principle of an image forming apparatus according to the present invention.

First, a description will be given of the operating principle of an image forming apparatus according to the present invention, by referring to FIG. 1. An image forming apparatus comprises a sequence control means A for controlling a sequential operation of the image formation, a plurality of paper detecting means B for detecting an existance of paper at a plurality of positions of paper transport paths, a transport abnormality detecting means C for detecting a transport abnormality during the sequential operation which is controlled by the sequence control means A based on output signals of the plurality of paper detecting means B, and an abnormality stop means D for stopping the sequential operation which is controlled by the sequence control means A when the transport abnormality is detected by the transport abnormality detecting means C.

According to one aspect of the present invention, the image forming apparatus also includes a remaining paper counting means E for counting a number of sheets of paper remaining within the paper transport paths during the sequential operation and a remaining paper display means F for displaying the number of sheets of paper counted by the remaining paper counting means E when the transport abnormality is detected by the transport abnormality detecting means C. Accordingly, when the transport abnormality is detected by the transport abnormality detecting means C, the abnormality stop means D stops the sequential operation which is controlled by the sequence control means A, and at the same time, the remaining paper display means F displays the number of sheets of paper counted by the remaining paper counting means E. As a result, the operator is not only informed of the transport abnormality but is also informed of the number of sheets of paper remaining within the image forming apparatus, thereby making it possible to quickly and positively remove all the sheets of paper remaining within the image forming apparatus when the transport abnormality occurs.

According to another aspect of the present invention, the image forming apparatus also includes a stop cancelling means G for cancelling the sequential operation stopping operation of the abnormality stop means D when the output of the paper detecting means B changes from a signal indicating the existence of paper to a signal indicating the non-existence of paper during the stopped state of the sequential operation. Accordingly, the stop cancelling means G starts to cancel the sequential operation stopping operation of the abnormality stop means D when the output of the paper detecting means B changes from the signal indicating the existence of paper to the signal indicating the non-existence of paper during the stopped state of the sequential operation. Hence, when the transport abnormality occurs in a paper eject part, for example, the sequential operation stopping operation is automatically cancelled by merely removing the paper remaining in the ejecting part, without the need to open and close a cover or to push a reset button.

According to still another aspect of the present invention, the image forming apparatus also includes a stop cancelling means G for cancelling the sequential operation stopping operation of the abnormality stop means D when the output of the paper detecting means B changes from a signal indicating the existence of paper to a signal indicating the non-existence of paper during the stopped state of the sequential operation, and the cancelling operation of the stop cancelling means G is successively carried out in response to the outputs of the plurality of paper detecting means B in a sequence starting from the output of the paper detecting means B which is arranged in the paper transport path located on a most downstream side out of the paper transport paths. Accordingly, the cancelling of the sequential operation stopping operation is carried out starting from the paper transport path which is located on the most downstream side, thereby making it possible to use the paper transport path which is located on the most downstream side for the image formation when the sequential operation stopping operation is carried out with respect to this paper transport path before the sequential operation stopping operation is cancelled for all the paper transport paths.

Figure 2:
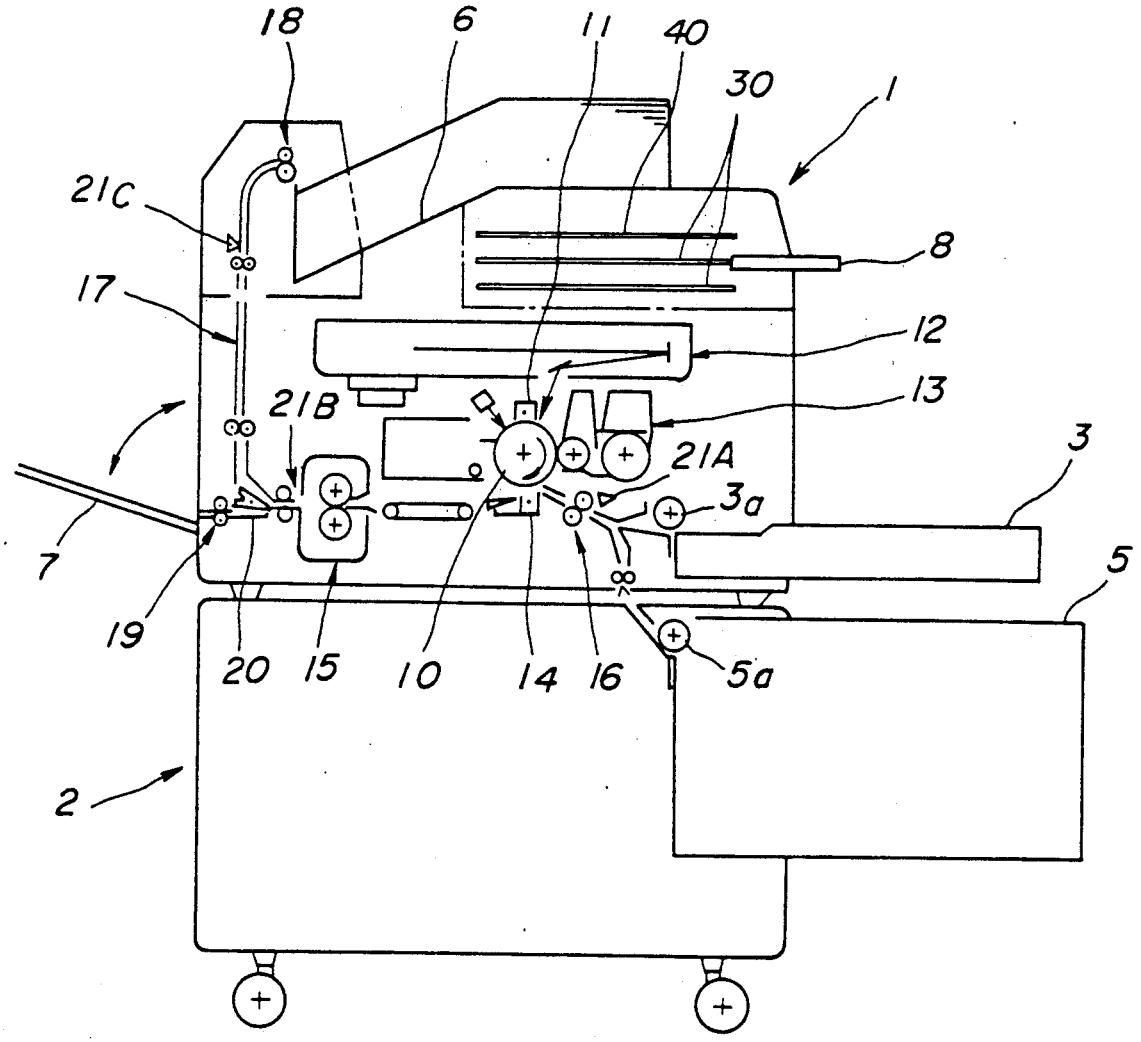
FIG. 2 is a front view in partial cross section generally showing internal mechanisms of a first embodiment of an image forming apparatus according to the present invention.

Next, a description will be given of a first embodiment of the image forming apparatus according to the present invention. In this embodiment, the present invention is applied to a laser printer. FIG. 2 shows internal mechanism of the laser printer.

In FIG. 2, the laser printer comprises a main printer body 1 and a table 2. A paper supply tray (cassette) 3 is detachably provided on a right side of the main printer body 1, and a first paper eject tray 6 is provided on an upper portion of the main printer body 1. A second paper eject tray 7 which can be opened and closed as indicated by an arrow is provided on a left side of the main printer body 1. An emulation card 8 is detachably provided on a side surface of the upper portion of the main printer body 1.

A photosensitive drum 10, a charger 11 which is arranged on a periphery of the photosensitive drum 10, a laser write unit 12, a developing unit 13, a transfer charger 14, a fixing unit 15, supply rollers **3*a* and 5*a* which function as paper transport means, resist rollers 16, a transport part 17 for ejecting paper and including a plurality of transport rollers, paper guide plates and the like, upper paper eject rollers 18, horizontal paper eject rollers 19, a switch claw 20 for switching paper ejecting paths and the like are provided within the main printer body 1**.

In this embodiment, a plurality of paper transport paths are formed within the main printer body 1. Such paper transport paths are formed between the paper supply tray 3 and a large capacity paper supply unit 5 and the first and second paper eject trays 6 and 7, between the paper transport means and the photosensitive drum 10, between the paper transport means and the transfer charger 14, between the paper transport means and the fixing unit 15 and the like.

Sensors are provided at a plurality of locations within the paper transport paths. The sensors function as paper detecting means for detecting an existence of paper in the paper transport path. A resist sensor 21A is provided immediately before the resist rollers 16 along the paper transport direction. A fixing sensor 21B is provided at an exit of the fixing unit 15. An eject sensor 21C is provided at an intermediate portion of the transport part 17. A photosensor, a microswitch and the like may be used for these sensors.

Figure 3:
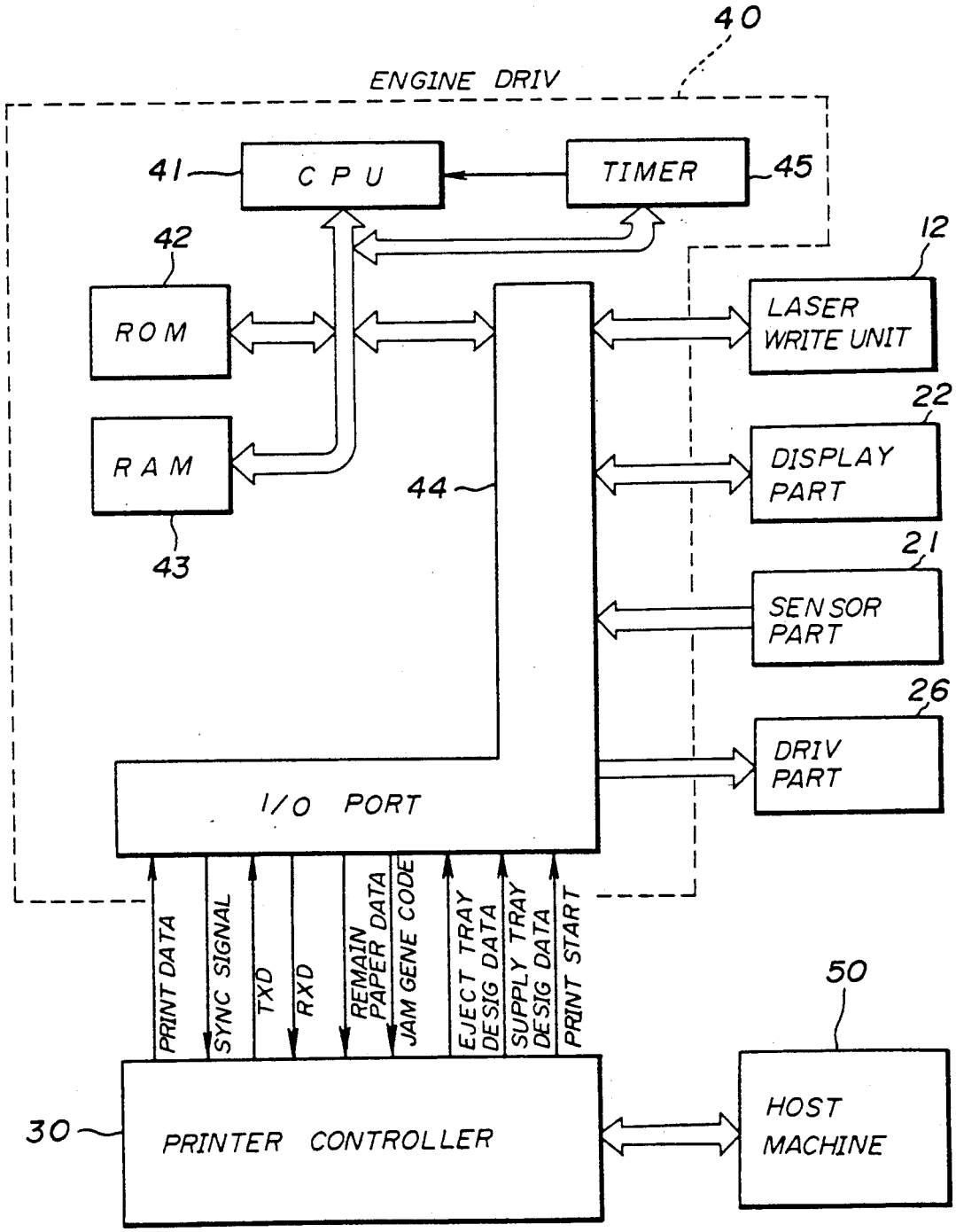
FIG. 3 is a system block diagram showing an embodiment of a control part of the first embodiment.

A substrate of a printer controller 30 and an engine driver 40 which will be described later in conjunction with FIG. 3 is provided on the upper portion of the main printer body 1.

The large capacity paper supply unit 5 is provided on a side portion of the table 2.

The operation of the laser printer is controlled by the printer controller 30 and the engine driver 40. The printer controller 30 generates print data for printing based on image data received from a host (not shown). The printer controller 30 supplies the print data, a print start request signal, a paper supply tray selection signal, an paper eject tray selection signal and the like to the engine driver 40, and the print operation is started when the engine driver 40 receives these signals.

When the print operation starts, the paper is supplied from a selected one of the paper supply tray 3 and the large capacity paper supply unit 5 via a corresponding one of the paper supply rollers **3*a* and 5*a* with a predetermined timing. The supply of the paper temporarily stops when the tip end of the paper hits the resist rollers 16**.

On the other hand, the photosensitive drum 10 rotates in a direction of an arrow in FIG. 2 and a surface of the photosensitive drum 10 is uniformly charged by the charger 11. A laser beam which is modulated depending on the print data from the printer controller 30 is emitted by the laser write unit 12. This laser beam scans the charged surface of the photosensitive drum 10 in a main direction which is along the drum axis and forms an electrostatic image on the surface of the photosensitive drum 10 by exposure.

The electrostatic image which is formed on the photosensitive drum 10 is developed into a toner image by the developing unit 13, and the transfer charger 14 transfers the toner image on the paper which is supplied from the resist rollers 16 with a predetermined timing. Furthermore, the toner image is thermally fixed by the fixing unit 15 and the printed paper having the fixed toner image printed thereon is ejected to the first paper eject tray 6 via the transport part 17 or is ejected directly to the second paper eject tray 7.

FIG. 3 shows an embodiment of a control part of the laser printer. The printer controller 30 comprises a central processing unit (CPU), a read only memory (ROM) for storing programs, a random access memory (RAM) having a large memory capacity, an input/output port and the like which are coupled to each other via a bus. The printer controller 30 is coupled to the engine driver 40 via a plurality of signal lines. The printer controller 30 is also coupled to an external host machine 50 which outputs the image data and the like.

The printer controller 30 constitutes an image processing part. The printer controller 30 receives a print command, character code data, image data and the like from the host machine 50 and edits the received data. When the character code data is received, the printer controller 30 carries out a conversion to obtain the print data for each page by use of character fonts prestored within the printer controller 30. The print data is output to the engine driver 40 in synchronism with a synchronizing signal (write clock signal) which is received from the engine driver 40.

The engine driver 40 constitutes a sequence control part which controls the sequential operation of the laser printer when making the print (image formation). The engine driver 40 comprises a CPU 41, a ROM 42 for storing programs required for the sequence control and fixed data, a RAM 43 for temporarily storing data, an input/output port 44 for controlling input and output of data, and a timer 45. The engine driver 40 is coupled to the printer controller 30 via a plurality bus lines which include data and address buses.

The engine driver 40 is coupled to the printer controller 30 via the input/output port 44, and is also coupled to the laser write unit 12, a display part 22 which is provided at a visible portion of the main printer body 1, a sensor part 21 which includes the sensors 21A through 21C and the like, and a driving part 26 via the input/output port 44. The driving part 26 includes clutches and the like which control motors for rotating the various transport rollers and the transmission of driving forces of these motors.

Although not shown, a high voltage power source for applying a high voltage to the charger 11 and the transfer charger 14, a power source for supplying a current to a fixing heater of the fixing unit 15 and the like are also coupled to the engine driver 40. The engine driver 40 also controls these power sources with predetermined timings to carry out the sequence control during the print operation.

The CPU 41 of the engine driver 40 function as the sequence control means A, the transport abnormality detecting means C, the abnormality stop means D, the remaining paper counting means E, and the stop cancelling means G shown in FIG. 1.

Figure 4:
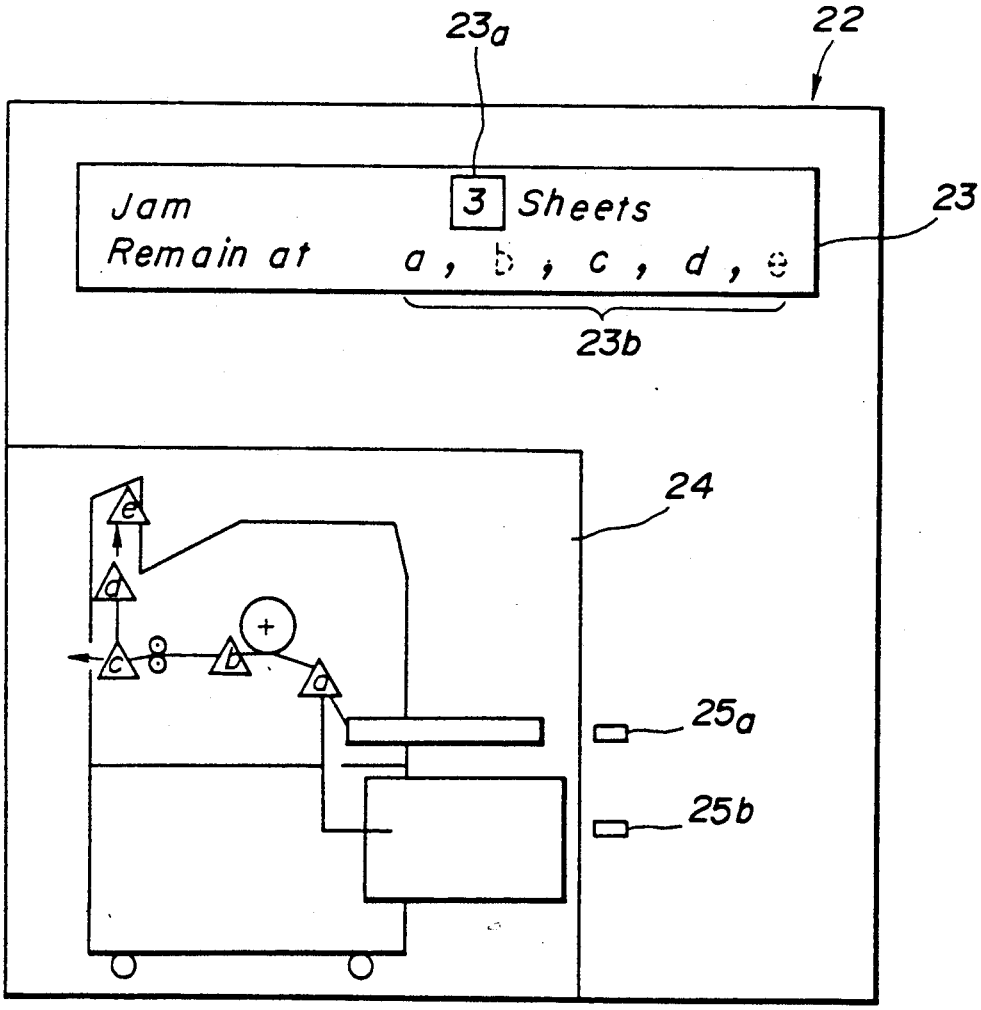
FIG. 4 is a diagram showing an embodiment of a display part of the first embodiment.

FIG. 4 shows an embodiment of the display part 22. The display part 22 comprises a character display 23 capable of displaying two lines of characters by a liquid crystal display (LCD), a display 24 which has an illustration resembling the general shape of the laser printer, and light emitting diodes (LEDs) 25*a* and 25*b* for displaying the selection of the paper supply tray 3 and the large capacity paper supply unit 5.

The character display 23 comprises a display part 23*a* and an indicator part 23*b*. The display part 23*a* displays the number of sheets of paper remaining within the laser printer when a paper jam occurs, and corresponds to the remaining paper counting means F shown in FIG. 1. The indicator part 23*b* indicates the positions within the laser printer where the sheets of paper remain by use of symbols "a" through "e" which are displayed by LEDs of the display part 24.

The display part 24 comprises five LEDs "a" through "e" which display the positions where the sheets of paper remain within the laser printer at corresponding positions within the illustration of the display part 24.

The LEDs 25*a* and 25*b* are arranged at positions in a vicinity of the illustration of the display 24 and corresponding to the positions of the paper supply tray 3 and the large capacity paper supply unit 5. The LED 25*a* turns ON when the paper supply tray 3 is selected, and the LED 25*b* is selected when the large capacity paper supply unit 5 is selected.

During the sequential operation of the laser printer, the CPU 41 of the engine driver 40 checks the signals received from the sensors 21A through 21C with a predetermined timing which is set in the timer 45. Hence, the CPU 41 monitors the transport abnormality (paper jam) and counts the number of sheets of paper remaining within the laser printer based on a difference between the number of sheets supplied and the number of sheets ejected.

The CPU 41 detects the paper jam immediately when it occurs. When the paper jam is detected, the CPU 41 stops the sequential operation and supplies to the display part 22 data on the position where the paper jam is generated and the number of sheets of paper remaining within the laser printer. As a result, the number of sheets of paper remaining is displayed on the display part 23*a* and the position where the paper jam is generated is indicated by "a" through "e" on the indicator part 23*b*. For example, the display part 23 displays a number "3" and and "a", "c" and "d" are indicated on the indicator part 23*b*. At the same time, only those ones of the LEDs "a" through "e" corresponding to the positions where the sheets of paper exist are turned ON in the display part 24.

Accordingly, the operator is informed of the generation of the paper jam, the number of sheets of paper remaining within the laser printer and the positions where the sheets of paper remain. For this reason, the operator can quickly and positively remove all sheets of paper remaining within the laser printer when the paper jam occurs, thereby making it possible to quickly eliminate the paper jam.

Next, a description will be given of the data communication between the printer controller 30 and the engine driver 40. As shown in FIG. 3, the printer controller 30 supplies to the engine driver 40 a print start command, a paper supply tray designation data, a paper eject tray designation data, print data and other serial communication data TXD. The printer controller 30 receives from the engine driver 40 the synchronizing signal for print data transfer, serial communication data RXD, a jam generation code which indicates the position where the jam is generated and a remaining paper data which indicates the number of sheets of paper remaining within the laser printer when the paper jam occurs.

The printer controller 30 receives the remaining paper data and can thus know the number of sheets remaining within the laser printer when the jam occurs. Hence, by returning to the print data by a number of pages corresponding to the number of sheets remaining, it is possible to print from the correct page when the print operation is resumed.

The RAM 43 within the engine driver 40 comprises an 8-bit register IOSEL for storing paper supply/eject tray designation data shown in FIG. 5. Bits b1 and b0 of the paper supply/eject tray designation data are used as the paper supply tray designation data, and bits b5 and b4 of the paper supply/eject tray designation data are used as the paper eject tray designation data. For example, the bits b1 and b0 respectively are "0" when designating the paper supply tray 3 and are "0" and "1" when designating the paper supply unit 5. And for example, the bits b5 and b4 respectively are "0" when designating the first paper eject tray 6 and are "0" and "1" when designating the second paper eject tray 7.

Next, the operation of the CPU 41 shown in FIG. 3 will be described by referring to timing charts of FIGS. 6(A) through 6(D) and flow charts shown in FIGS. 7 through 16.

The RAM within the CPU 41 (or the RAM 43) and the timer 45 have various kinds of counters and flags which are listed below.

CSTART: Start Counter
CPRNT: Printing Paper Counter
CFSYNC: FSYNC Counter
CTRST: Transport Start Counter
CHECK0: Paper Supply Check Counter
CHECK1: Transport Check Counter
CHECK2: Fixing Check Counter
CHECK3: Fixing and Eject Check Counter
CHECK4: First Eject Check Counter
CHECK5: Second Eject Check Counter The start counter CSTART is an address counter of the register IOSEL for setting the paper supply tray designation data and the paper eject tray designation data which are received from the printer controller 30.

The printing paper counter CPRNT counts the number of sheets of paper remaining within the laser printer and corresponds to the remaining paper counting means E shown in FIG. 1.

The FSYNC counter CFSYNC supervises the number of main scanning lines and the number of lines set differs depending on the paper size.

The above described counters CSTART, CPRNT and CFSYNC are provided in the RAM within the CPU 41 (or in the RAM 43).

The transport start counter CTRST supervises the time from a time when the synchronizing signal (frame gate signal) turns ON to a time when the transport of the paper starts.

The check counters CHECK0 through CHECK5 respectively detect the generation of the transport abnormality (paper jam). The check counter CHECK0 is used for checking an erroneous paper supply and supervises a time $t_0$ from a the time when the paper supply starts to a time when the resist sensor 21A turns ON.

The check counter CHECK1 is used for checking an erroneous paper transport and supervises a time $t_1$ shown in FIG. 6(A) from a time when the paper transport starts to a time when the resist sensor 21A turns OFF.

The check counter CHECK2 is used for checking an erroneous fixing and supervises a time $t_2$ shown in FIG. 6(B) from a time when the paper transport starts to a time when the fixing sensor 21B turns ON.

The check counter CHECK3 is used for checking an erroneous fixing and paper ejection and supervises a time $t_3$ shown in FIG. 6(C) from a time when the fixing sensor 21B turns ON to a time when the fixing sensor 21B turns OFF.

The first eject check counter CHECK4 is used for checking an erroneous paper ejection (that is, a paper jam within the transport part 17 shown in FIG. 2) and supervises a time $t_4$ shown in FIG. 6(C) from the time when the fixing sensor 21B turns ON to a time when the eject sensor 21C turns ON.

The second eject check counter CHECK5 is used for checking an erroneous paper ejection (that is, a paper jam at the opening through which the paper is ejected onto the first paper eject tray 6) and supervises a time $t_5$ shown in FIG. 6(D) from the time when the fixing sensor 21B turns ON to a time when the eject sensor 32C turns OFF.

The check counters CHECK0 through CHECK5 are provided within the timer 45 shown in FIG. 3. The times $t_0$ through $t_5$ mentioned above differ depending on the paper size.

Next, a description will be given of a main routine of the CPU 41, by referring to FIG. 7. When the main routine is started, a step S1 makes various error checks including a jam release check routine which will be described later by carrying out a subroutine. A step S2 discriminates whether or not no error is detected by the step S1. When the discrimination result in the step S2 becomes YES, a step S3 makes a start check by carrying out a subroutine.

A step S4 discriminates whether or not a start flag is ON. When the discrimination result in the step S4 becomes YES, a step S5 makes a paper supply control by carrying out a subroutine. A step S6 discriminates whether or not a write flag is ON. When the discrimination result in the step S6 becomes YES, a step S7 makes a write control by carrying out a subroutine. A step S8 discriminates whether or not a transport flag is ON. When the discrimination result in the step S8 becomes YES, a step S9 makes a transport control by carrying out a subroutine. A step S10 discriminates whether or not a fixing flag is ON. When the discrimination result in the step S10 becomes YES, a step S11 makes a transport check by carrying out a subroutine. A step S12 discriminates whether or not a fixing an paper eject flag is ON. When the discrimination result in the step S12 becomes YES, a step S13 makes a fixing and paper eject check by carrying out a subroutine. A step S14 discriminates whether or not a first paper eject flag is ON. When the discrimination result in the step S14 becomes YES, a step S15 makes a first paper eject check by carrying out a subroutine. A step S16 discriminates whether or not a second paper eject flag is ON. When the discrimination result in the step S16 becomes YES, a step S17 makes a second paper eject check by carrying out a subroutine. The process returns to the step S1 after the step S17.

Figure 7:
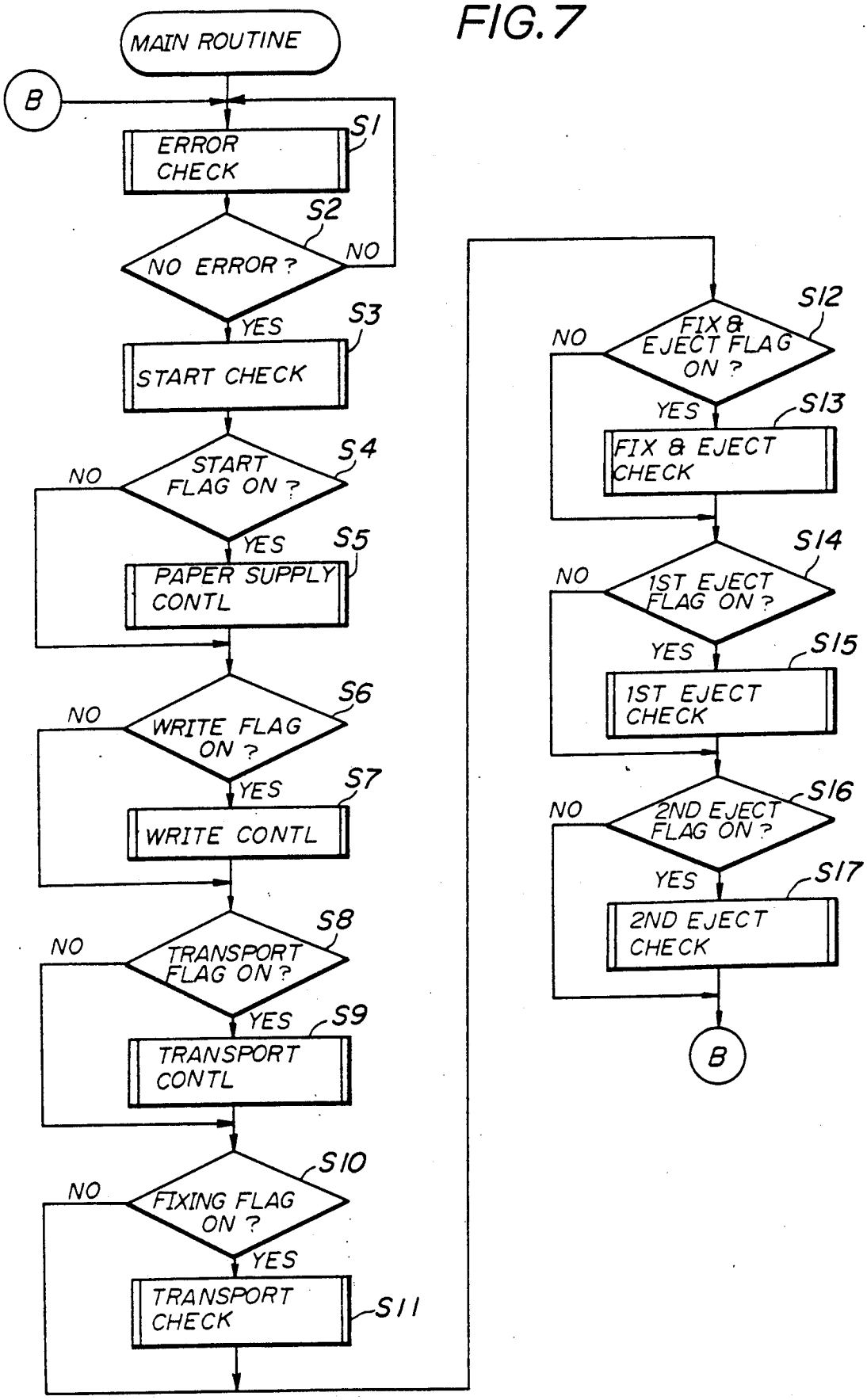
FIGS. 7 through 16 respectively are flow charts for explaining the operation of the first embodiment.

The sequence in which the steps S1 through S17 are carried out is not limited to that shown in FIG. 7. The sequence may be arbitrary as long as the steps are successively carried out in a circulative manner.

Figure 8:
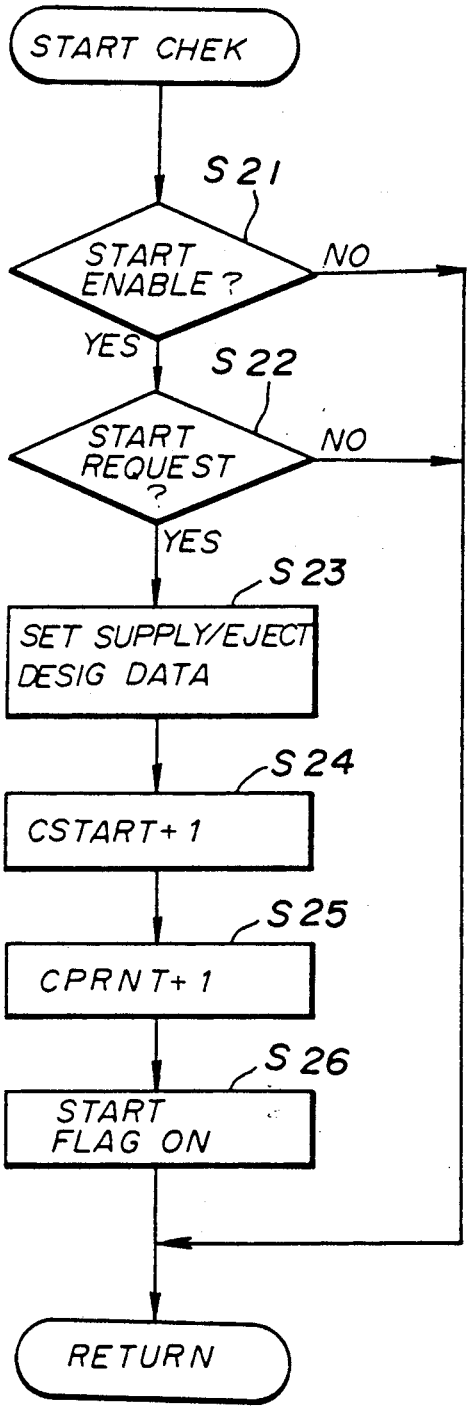

FIG. 8 shows an embodiment of the start check subroutine. When the start check subroutine is started, a step S21 discriminates whether or not the laser printer is in a start enable state. When the discrimination result in the step S21 is YES, a step S22 discriminates whether or not a start request is made based on the print start command which is received from the printer controller 30. When the discrimination result in the step S22 is YES, a step S23 increments the value in the start counter CSTART by one and a step S24 increments the value in the printing paper counter CPRNT by one. When it is assumed that the value indicated by the start counter CSTART denotes the lower address, the paper supply/eject tray designation data is set in the register IOSEL shown in FIG. 5 and the values in the counters CSTART and CPRNT are thereafter incremented. A step S26 turns ON the start flag so as to start the print sequence.

The process returns to the main routine when the discrimination result in the step S21 or S22 is NO or after the step S26.

Figure 9:
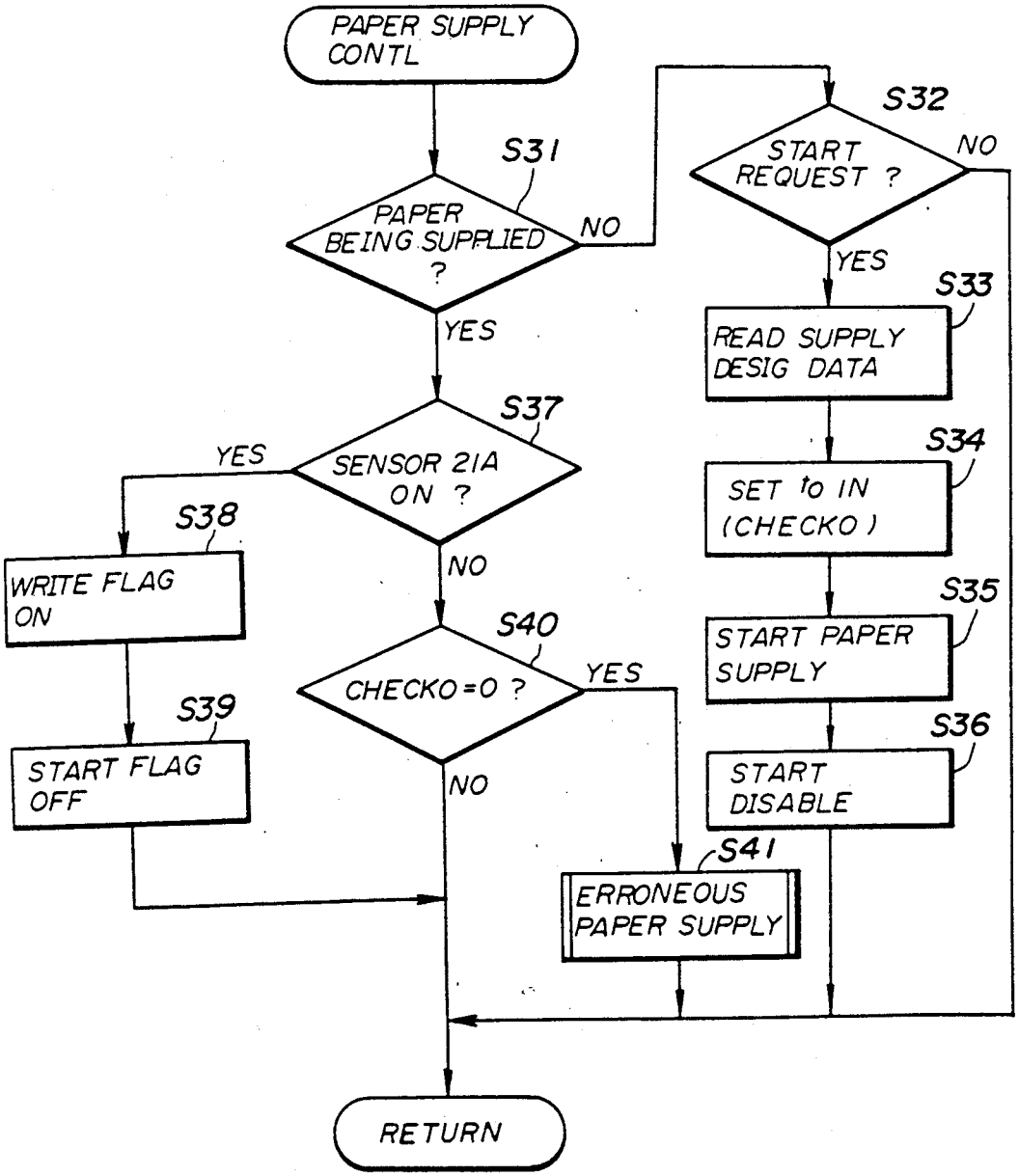

FIG. 9 shows an embodiment of the paper supply control subroutine. This paper supply control subroutine is started when the start flag is ON, and a step S31 discriminates whether or not the paper is being supplied in the laser printer.

At first, the discrimination result in the step S31 is NO. Hence, a step S32 discriminates whether or not the start request is received. When the discrimination result in the step S32 is YES, a step S33 reads the paper supply tray designation data from the bits b1 and b0 of the register IOSEL so as to select the paper supply tray which is designated thereby. A step S34 sets the time $t_0$ in the paper supply check counter CHECK0. A step S35 starts the paper supply, and a step S36 makes a start disable so as to disable accepting a next print start request.

After the paper supply is started, the discrimination result in the step S31 is YES. Hence, a step S37 discriminates whether or not the resist sensor 21A is ON. When the discrimination result in the step S37 is YES, a step S38 turns a write flag ON and a step S39 turns the start flag OFF. As a result, the paper supply is ended in a state where the tip end of the paper hits the resist rollers 16.

On the other hand, when the discrimination result in the step S37 is NO, a step S40 discriminates whether or not the value in the paper supply check counter CHECK0 is "0". When the discrimination result in the step S40 is YES, a step S41 performs a process with respect to the erroneous paper supply by carrying out a subroutine.

The process returns to the main routine when the discrimination result in the step S32 or s40 is NO or after any of the steps S36, S39 and S41.

Figure 10:
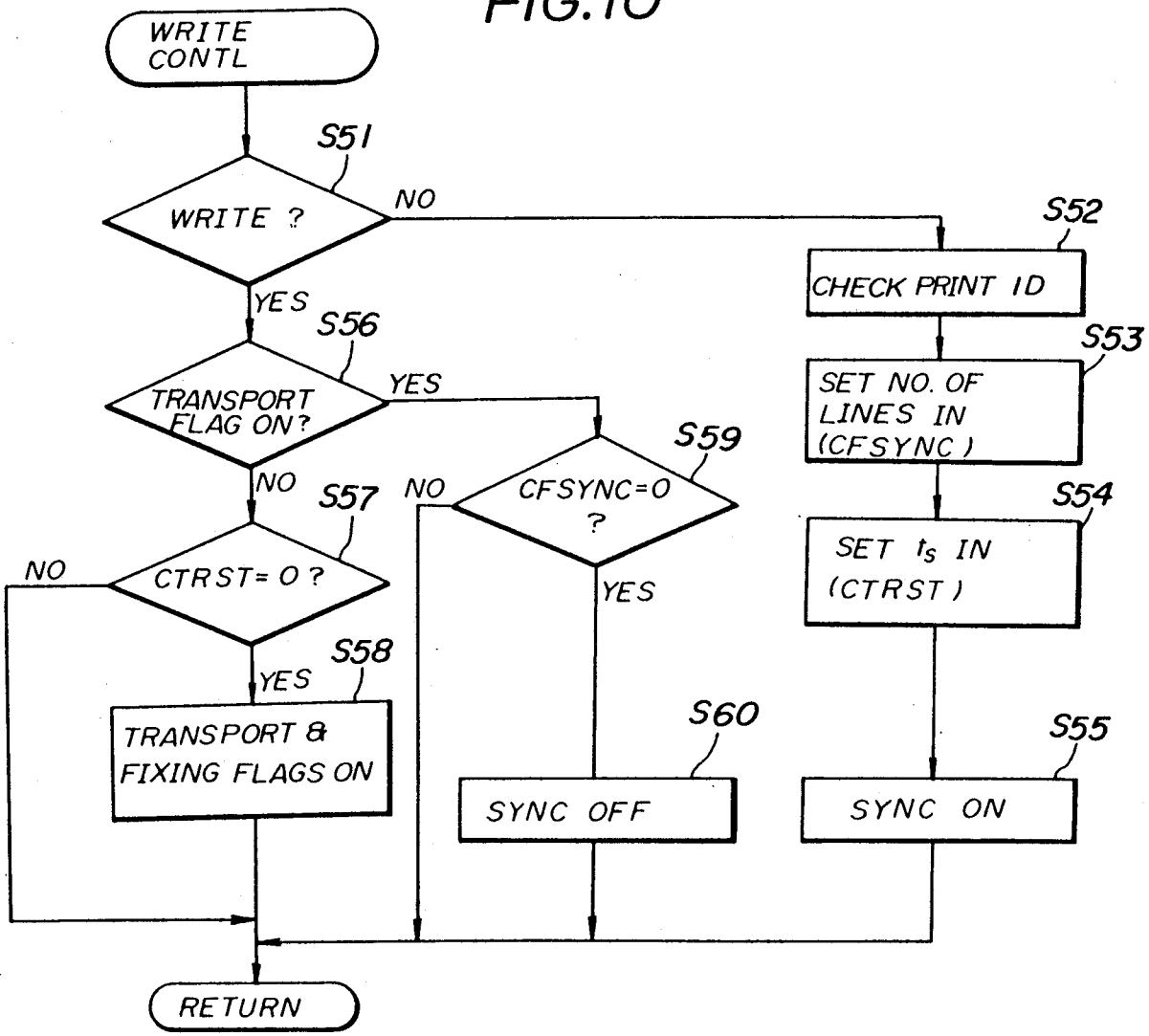

FIG. 10 shows an embodiment of the write control subroutine. This write control subroutine is started when the write flag is ON, and a step S51 discriminates whether or not the write operation is being carried out in the laser printer.

At first, the discrimination result in the step S51 is NO. Hence, a step S52 checks a print identification ID and a step S53 sets in the FSYNC counter CFSYNC a number of lines dependent on the paper size. A step S54 sets in the transport start counter CTRST a time $t_s$ from the time when the synchronizing signal (frame gate signal) turns ON to the time when the paper transport starts. A step S55 turns the synchronizing signal (frame gate signal) ON.

After the write operation is started, the discrimination result in the step S51 becomes YES and a step S56 discriminates whether or not a transport flag is ON. When the discrimination result in the step S56 is NO, a step S57 discriminates whether or not the value in the start counter CTRST is "0". When the discrimination result in the step S57 is YES, a step S58 turns the transport flag and a fixing flag ON.

On the other hand, when the discrimination result in the step S56 is YES, a step S59 discriminates whether or not the value in the FSYNC counter CFSYNC is "0". When the discrimination result in the step S59 is YES, a step S60 turns the synchronizing signal (frame gate signal) ON.

The process returns to the main routine when the discrimination result in the step S57 or S59 is NO or after any of the steps S55, S58 and S60.

Figure 11:
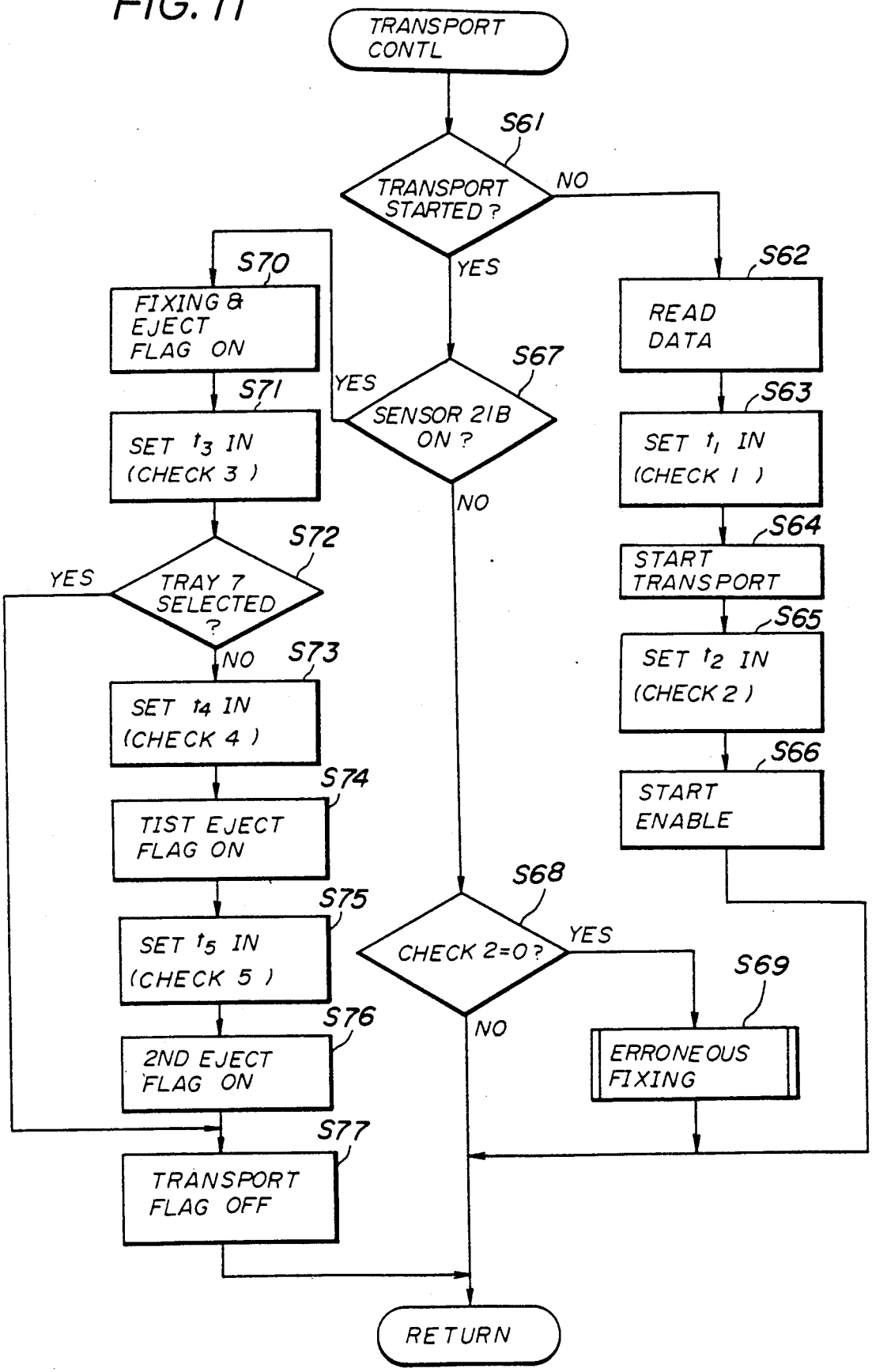

FIG. 11 shows an embodiment of the transport control subroutine. This transport control subroutine is started when the transport flag is ON, and a step S61 discriminates whether or not the paper transport is already started.

At first, the discrimination result in the step S61 is NO. Thus, a step S62 reads the paper eject tray designation data from the bits b5 and b4 of the register IOSEL and switches the switch claw 20 shown in FIG. 2 according to the designated paper eject tray. A step S63 sets the time $t_1$ in the transport check counter CHECK1 and a step S64 starts the paper transport by driving the resist rollers 16 shown in FIG. 2. A step S65 sets the time $t_2$ in the fixing check counter CHECK2, and a step S66 makes a start enable so as to enable accepting the next print start request.

After the paper transport is started, the discrimination result in the step S61 becomes YES and a step S67 discriminates whether or not the fixing sensor 21B is ON. When the discrimination result in the step S67 is NO, a step S68 discriminates whether or not the value in the fixing check counter CHECK2 is "0". When the discrimination result in the step S68 is YES but the tip end of the paper does not reach the fixing sensor 21B and the fixing sensor 21B does not become ON, a step S69 performs a process with respect to the erroneous fixing by carrying out a subroutine.

On the other hand, when the discrimination result in the step S67 becomes YES, a step S71 turns a fixing and eject flag ON, and a step S71 sets the time $t_3$ in the fixing and eject check counter CHECK3. A step S72 discriminates whether or not the second paper eject tray 7 is selected. When the discrimination result in the step S72 is YES, a step S77 turns the transport flag OFF. But when the discrimination result in the step S72 is NO, a step S73 sets the time $t_4$ in the first eject check counter CHECK4, and a step S74 turns a first eject flag ON. A step S75 sets the time $t_5$ in the eject check counter CHECK5, and a step S76 turns a second eject flag ON. The process advances to the step S77 after the step S76.

The process returns to the main routine when the discrimination result in the step S68 is NO or after any of the steps S66, S69 and S77.

Figure 12:
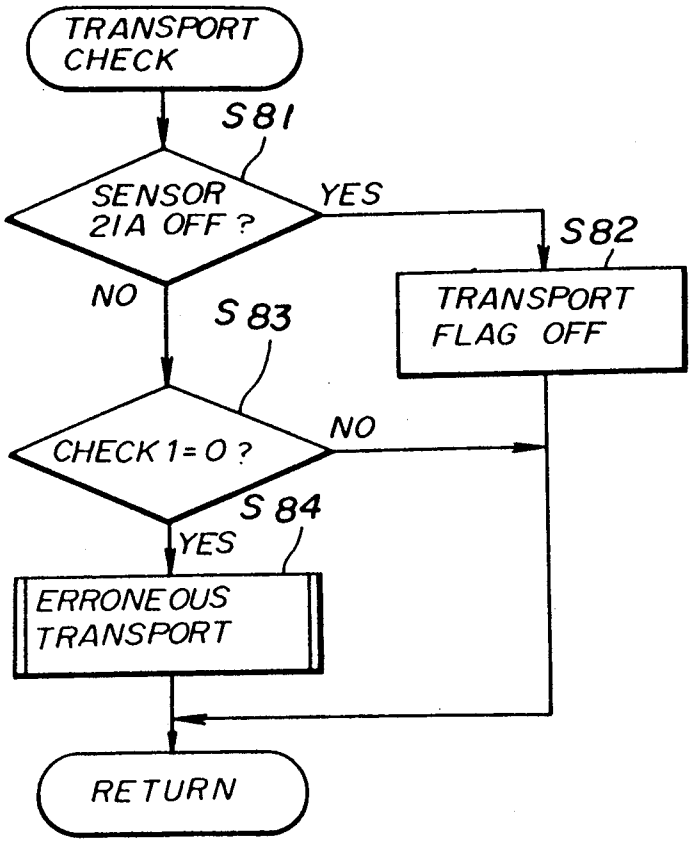

FIG. 12 shows an embodiment of the transport check subroutine. This transport check subroutine is started when the fixing flag is ON in the write control subroutine shown in FIG. 10. A step S81 whether or not the rear end of the paper has passed the resist sensor 21A and the resist sensor 21A is OFF. When the discrimination result in the step S81 is YES, a step S82 turns the transport flag OFF. On the other hand, when the discrimination result in the step S81 is NO, a step S83 discriminates whether or not the value in the transport check counter CHECK1 is "0". When the discrimination result in the step S83 is YES but the resist sensor 21A is OFF, a step S84 performs a process with respect to the erroneous paper transport by carrying out a subroutine.

The process returns to the main routine when the discrimination result in the step S83 is NO or after the step S82 or S84.

Figure 13:
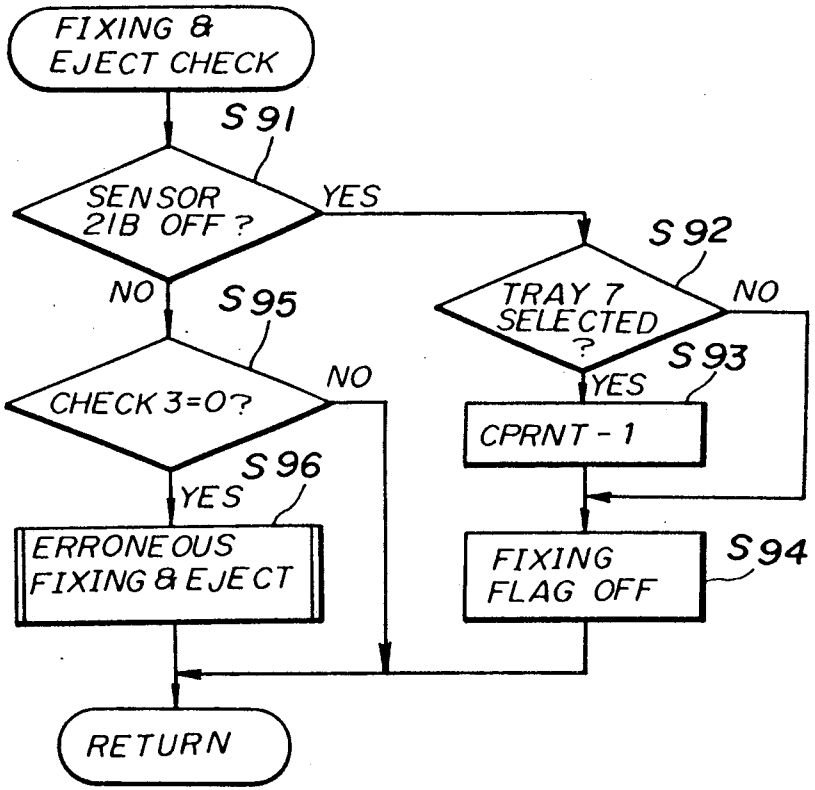

FIG. 13 shows an embodiment of the fixing and eject check subroutine. This fixing and eject check subroutine is started when the fixing and eject flag is ON in the transport control subroutine shown in FIG. 11. A step S91 discriminates whether or not the paper has passed the fixing unit 15 and the fixing sensor 21B is OFF. When the discrimination result in the step S91 is YES, a step S92 discriminates whether or not the second paper eject tray 7 is selected. When the discrimination result in the step S92 is YES, a step S93 decrements the value in the printing paper counter CPRNT by one. After the step S93 or when the discrimination result in the step S92 is NO, a step S94 turns the fixing flag OFF.

On the other hand, when the discrimination result in the step S91 is NO, a step S95 discriminates whether or not the value in the fix and eject check counter CHECK3 is "0". When the discrimination result in the step S95 is YES, a step S96 performs a process with respect to the erroneous fixing and paper ejection by carrying out a subroutine.

The process returns to the main routine when the discrimination result in the step S95 is NO or after the step S94 or S96.

Figure 14:
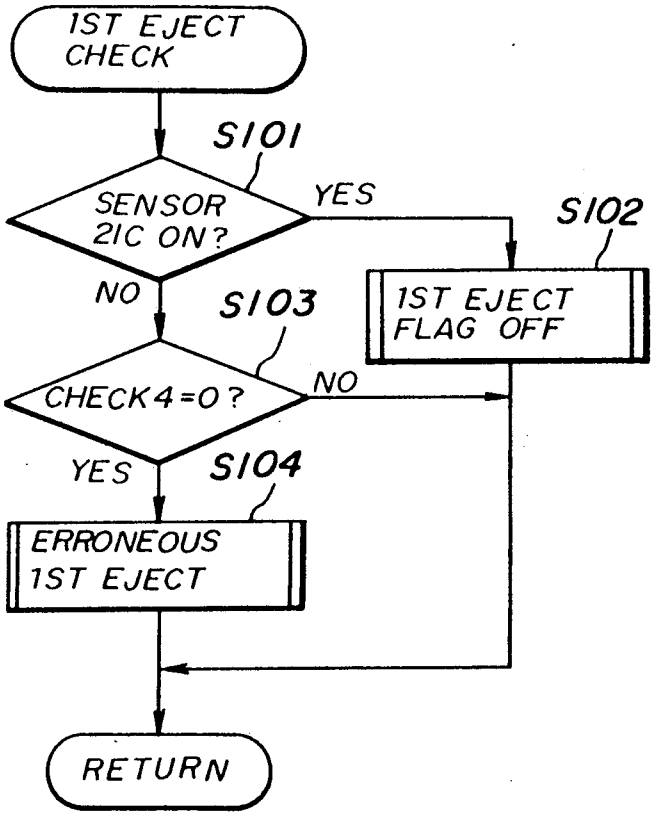

FIG. 14 shows an embodiment of the first eject check subroutine. This first eject check subroutine is started when the first eject flag is ON in the transport control subroutine shown in FIG. 11, and a step S101 discriminates whether or not the tip end of the paper has reached the eject sensor 21C and the eject sensor 21C is ON. When the discrimination result in the step S101 is YES, a step S102 turns the first eject flag OFF.

On the other hand, when the discrimination result in the step S101 is NO, a step S103 discriminates whether or not the value in the first eject check counter CHECK4 is "0". When the discrimination result in the step S103 is YES, a step S104 performs a process with respect to the first erroneous paper ejection by carrying out a subroutine.

The process returns to the main routine when the discrimination result in the step S103 is NO or after the step S102 or S104.

Figure 15:
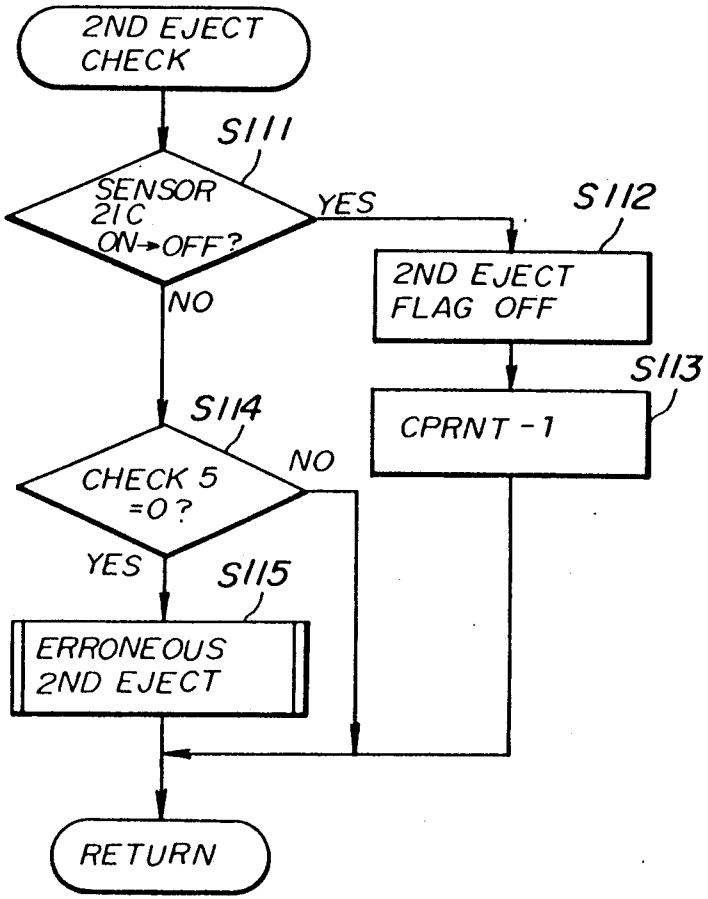

FIG. 15 shows an embodiment of the second eject check subroutine. This second eject check subroutine is started when the second eject flag is ON in the transport control subroutine shown in FIG. 11, and a step S111 discriminates whether or not the rear end of the paper has passed the eject sensor 21C and the eject sensor 21C changes from the ON state to the OFF state. When the discrimination result in the step S111 is YES, a step S112 turns the second eject flag OFF and a step S113 decrements the value in the printing paper counter CPRNT by one.

On the other hand, when the discrimination result in the step S111 is NO, a step S114 discriminates whether or not the value in the second eject check counter CHECK5 is "0". When the discrimination result in the step S114 is YES, a step S115 performs a process with respect to the second erroneous paper ejection by carrying out a subroutine.

The process returns to the main routine when the discrimination result in the step S114 is NO or after the step S113 or S115.

Next, a description will be given of the processes which are carried out with respect to the various errors when the transport abnormality (paper jam) occurs. The process which is carried out with respect to the erroneous paper supply prohibits the acceptance of a new print start request and stops the sequential operation after the paper which is presently being transported is ejected. This paper which is ejected is supplied before the paper which is involved with the erroneous paper supply. On the other hand, the processes which are carried out with respect to the erroneous paper transport, erroneous fixing, erroneous fixing and paper ejection, and erroneous first and second paper ejections respectively stop the sequential operation immediately when these errors are generated.

The above described processes which are carried out with respect to the various errors display the number of sheets of paper remaining within the laser printer when the paper jam occurs (hereinafter simply referred to as a jam number) and the positions within the laser printer where the sheets of paper remain (hereinafter simply referred to as jam positions) by use of the symbols "a" through "e". When the erroneous paper supply occurs, the jam position is displayed as "a" and the jam number is displayed as "1".

When other errors are generated, the jam number is displayed by displaying the number in the printing paper counter CPRNT. On the other hand, the jam position is displayed as follows. That is, the symbol "a" is displayed when the check counter CHECK1 is counting down, the symbol "b" is displayed when the check counter CHECK2 is counting down, the symbol "c" is displayed when the check counter CHECK3 is counting down, the symbol "d" is displayed when the check counter CHECK4 is counting down, and the symbol "e" is displayed when the check counter CHECK5 is counting down.

In addition, when the above described errors are generated, a jam generation code J and a jam number m (value in the printing paper counter CPRNT) are transmitted from the engine driver 40 to the printer controller 30.

Figure 16:
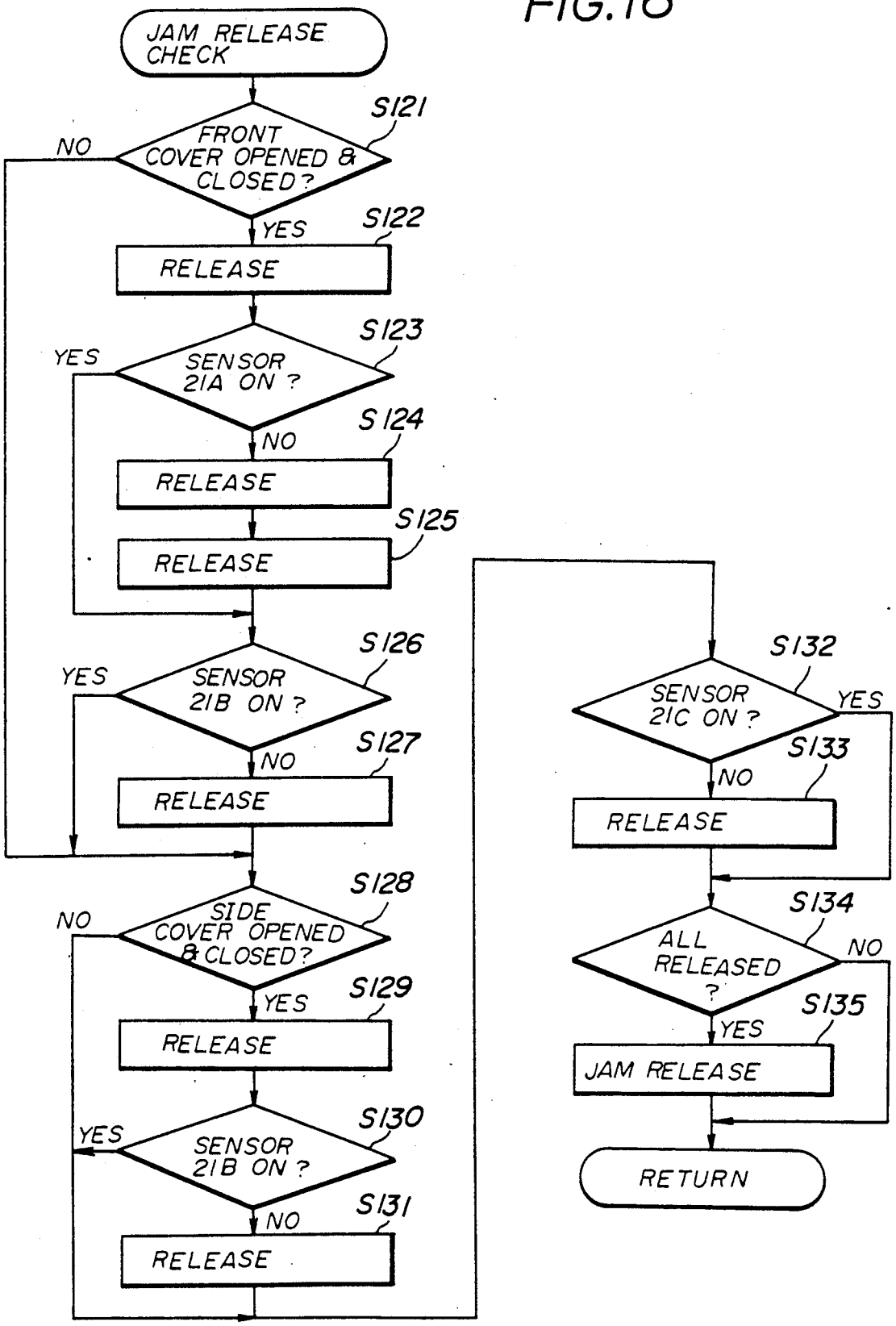

FIG. 16 shows an embodiment of a jam release check subroutine. This jam release check subroutine releases the laser printer from the abnormal stop state, that is, the paper jam, and is carried out in the error check subroutine of the main routine shown in FIG. 7.

The various errors are released in the following cases, and the paper jam is released when all of the erroneous paper transports are eliminated.

1) Erroneous Paper Supply:

The erroneous paper supply is released when the front cover of the laser printer is opened and closed. As shown in FIG. 16, a step S121 discriminates whether or not the front cover is opened and closed. When the discrimination result in the step S121 is YES, a step S122 releases the erroneous paper supply.

2) Erroneous Paper Transport and Fixing:

The erroneous paper transport and fixing are released when the resist sensor 21A does not detect the paper after the front cover of the laser printer is opened and closed. As shown in FIG. 16, a step S123 discriminates whether or not the resist sensor 21A is ON. When the discrimination result in the step S123 is NO, a step S124 releases the erroneous paper transport and a step S125 releases the erroneous fixing.

3) Erroneous Fixing and Paper Ejection:

The erroneous fixing and paper ejection is released when the fixing sensor 21B does not detect the paper after the front or side cover of the laser printer is opened and closed. As shown in FIG. 16, when the discrimination result in the step S123 is YES or after the step S125, a step S126 discriminates whether or not the fixing sensor 21B is ON. When the discrimination result in the step S126 is NO, a step S127 releases the erroneous fixing and paper ejection. Further, steps S130 and S131 are carried out similarly to the steps S126 and S127 after a step S129 which will be described later.

4) First Erroneous Paper Ejection:

The first erroneous paper ejection is released when the side cover is opened and closed. As shown in FIG. 16, a step S128 discriminates whether or not the side cover is opened and closed. This step S128 is carried out when the discrimination result in the step S121 is NO, the discrimination result in the step S126 is YES, or after the step S127. When the discrimination result in the step S128 is YES, the step S129 releases the first erroneous paper ejection.

5) Second Erroneous Paper Ejection:

The second erroneous paper ejection is released when the eject sensor 21C no longer detects the paper. As shown in FIG. 16, a step S132 discriminates whether or not the eject sensor 21C is ON. This step S132 is carried out when the discrimination result in the step S128 is NO, the discrimination result in the step S130 is YES, or after the step S131. When the discrimination result in the step S132 is NO, a step S133 releases the second erroneous paper ejection. Accordingly, when the paper jam occurs and the paper partially projects from the eject opening towards the first paper eject tray 6, the second erroneous paper ejection is released immediately when the projecting paper is pulled out and removed without the need to open and close the front or side cover.

When the discrimination result in the step S132 is YES or after the step S133 shown in FIG. 16, a step S134 discriminates whether or not all the erroneous paper transports are released. When the discrimination result in the step S134 is YES, a step S135 releases the paper jam. The process returns to the main routine when the discrimination result in the step S134 is NO or after the step S135.

Figure 17:
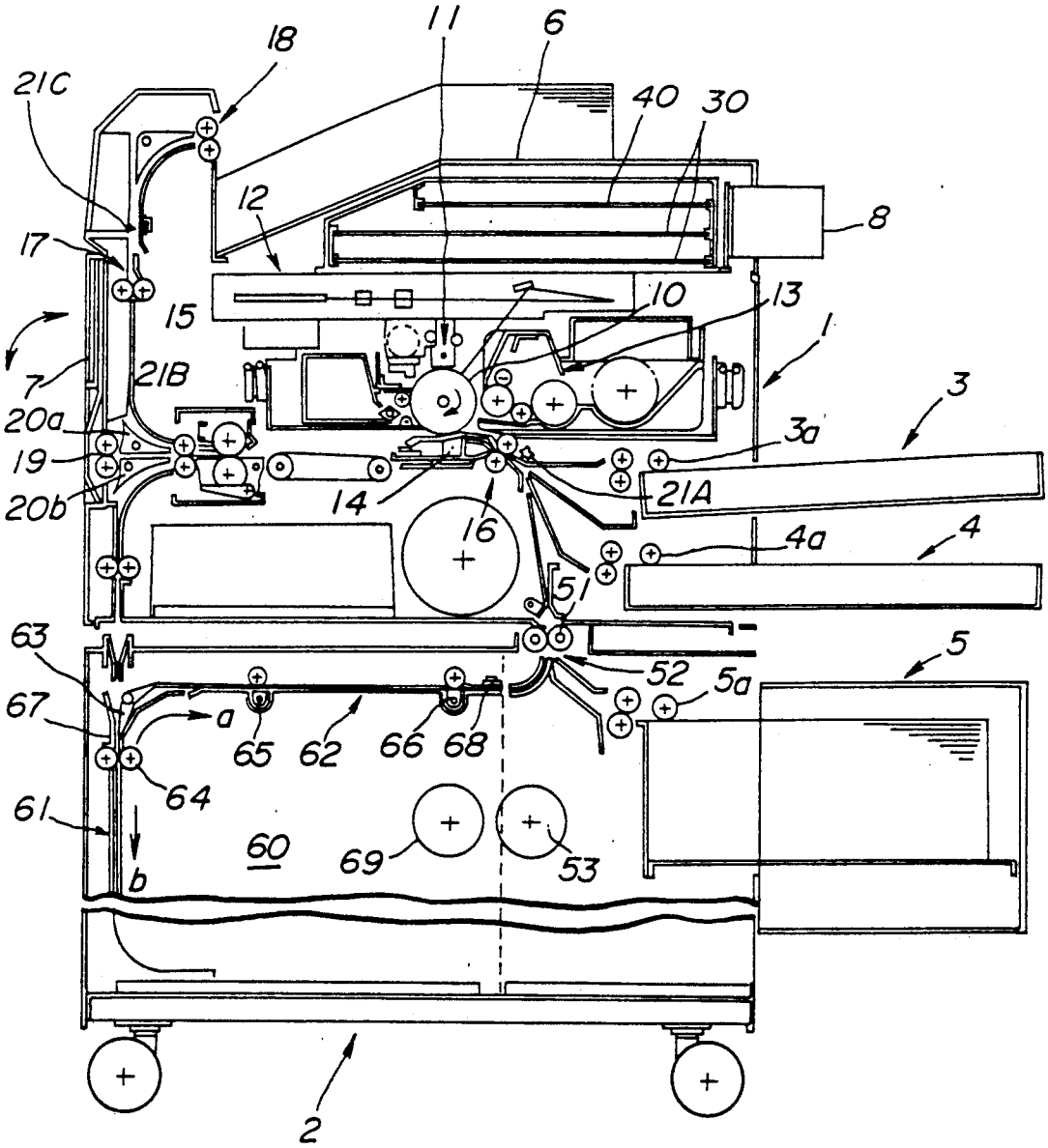
FIG. 17 is a front view in cross section showing internal mechanisms of a second embodiment of the image forming apparatus according to the present invention.

Next, a description will be given of a second embodiment of the image forming apparatus according to the present invention. In this embodiment, the present invention is also applied to a laser printer. FIG. 17 shows internal mechanism of this embodiment. In FIG. 17, those parts which are substantially the same as those corresponding parts in FIG. 2 are designated by the same reference numerals, and a description thereof will be omitted.

In this embodiment, upper and lower paper supply trays 3 and 4 are detachably provided on the main printer body 1. Hence, it is possible to select the paper supply from three kinds of paper supplies which are the upper and lower paper supply trays 3 and 4 and the large capacity paper supply unit 5. A roller 4*a* is provided to supply the paper from the lower paper supply tray 4.

In this embodiment, the laser printer can print on both sides of the paper and make two-sided prints. A duplex print unit 60 is built into the table 2. This duplex print unit 60 comprises a reversing transport path 61, a waiting transport path 56, a paper advancing path changing claw 63, three pairs of transport rollers 64, 65 and 66 which are respectively provided with a clutch and function as the transport means, a duplex unit entrance sensor 67, a duplex unit exit sensor 68, a duplex driving motor 69 and the like. In addition, paper transport rollers 51 which are also used in common for resupplying the one-sided print from the duplex print unit 60 to the main printer body 1 and for supplying the paper which is received from the large capacity paper supply unit 5 to the main printer body 1, a table exit sensor 52 and a paper supply unit driving motor 53 and the like are provided on the side of the large capacity paper supplying unit 5.

Two switch claws 20*a* and 20*b* for switching paper ejecting paths are provided within the main printer body 1.

The duplex driving motor 69 is linked to the transport rollers 64, 65 and 66 via gears and the like to drive these transport rollers 64, 65 and 66. One-way clutches are provided between the duplex driving motor 69 and the transport rollers 65 and 66, so that the transport rollers 64, 65 and 66 rotate so as to transport the paper in a direction a during a forward rotation of the duplex driving motor 69 but only the transport rollers 64 rotate so as to transport the paper in a direction b and the transport rollers 65 and 66 do not rotate during a reverse rotation of the duplex driving motor 69.

The paper supply unit driving motor 53 drives the paper supply rollers 5*a* and 51.

Figure 18:
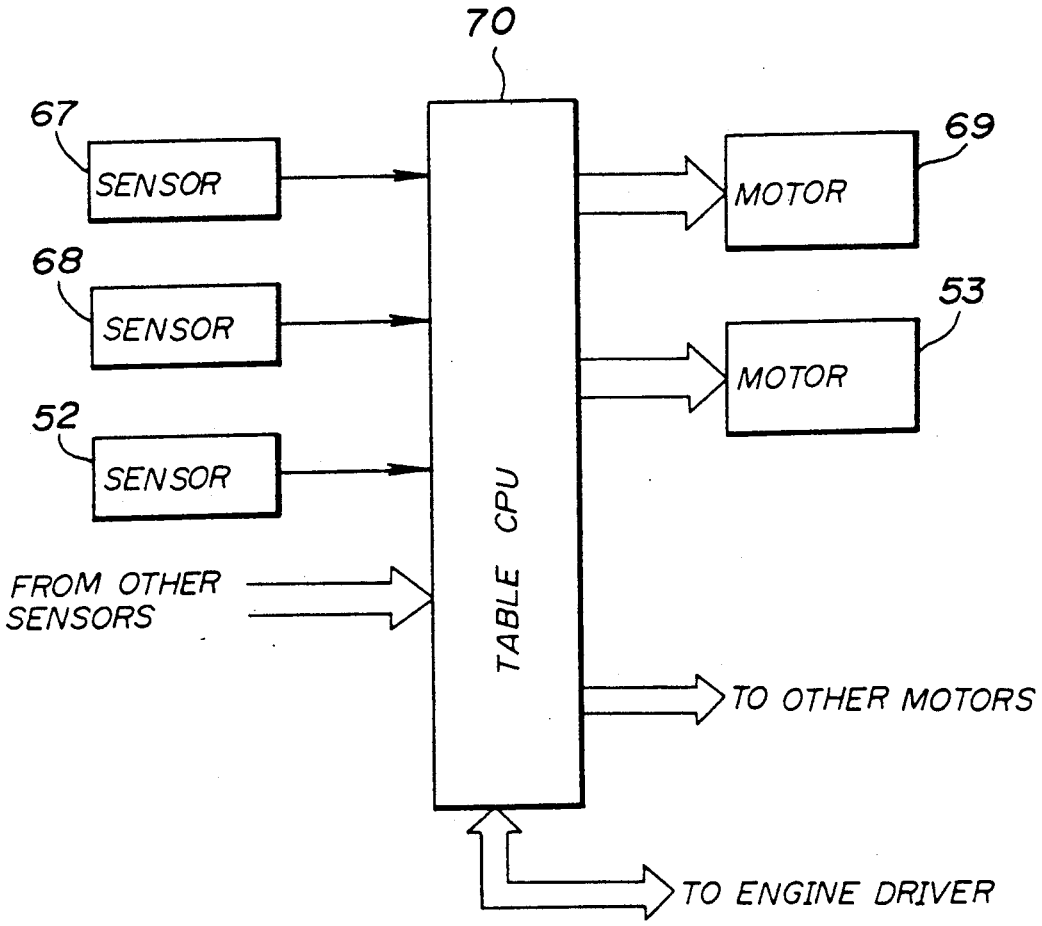
FIG. 18 is a system block diagram showing an embodiment of a control part of the second embodiment.

The parts within the table 2 are controlled by a table CPU 70 shown in FIG. 18. When an operation mode of the laser printer is set to a duplex print mode, the table CPU 70 enters output detection signals of the duplex unit entrance sensor 67, the duplex unit exit sensor 68 and the table exit sensor 52, and also control commands from the engine driver (not shown). Based on these received data, the table CPU 70 controls the duplex unit driving motor 69 and the paper supply unit driving motor 53 via drivers (not shown), and also carries out various discriminations and operations.

The engine driver within the main printer body 1 is constructed similarly to that shown in FIG. 3. The engine driver interchanges information between the table CPU according to a serial communication system. The engine driver transmits control commands to the table CPU 70 based on the sequence control commands received from the printer controller (not shown).

During the duplex print mode, the one-sided print which has an image printed on only one side of the paper in the main printer body 1 is guided by the switch claw 20*b*. Hence, the one-sided print is supplied from the main printer body 1 to the duplex print unit 60 within the table 2.

First, the one-sided print is supplied to the reversing transport path 61. Thereafter, the transport direction of the one-sided print is reversed and is transported to the waiting transport path 62. The one-sided print in the waiting transport path 62 is re-supplied to the main printer body 1 by the paper transport rollers 51 with a predetermined timing, so that an image is printed on the other side of the paper, that is, to obtain the two-sided print. The two-sided print is ejected onto the first paper eject tray 6 or the second paper eject tray 7.

Figure 19:
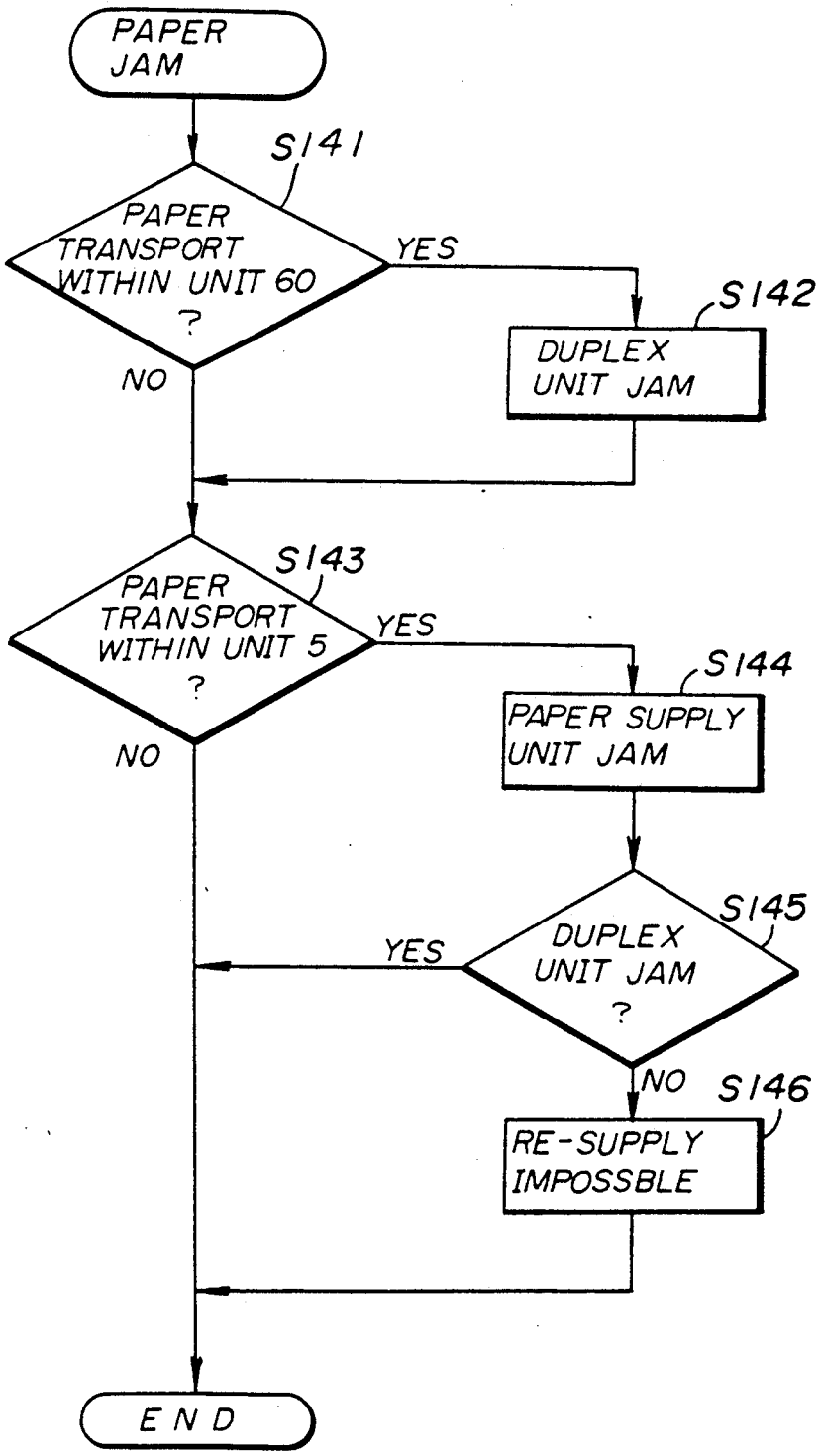
FIGS. 19 and 20 respectively are flow charts for explaining an operation of the second embodiment.

When a paper jam occurs within the table 2 of the laser printer shown in FIG. 17, the table CPU 70 shown in FIG. 18 carries out a process shown in FIG. 19 to stop the operation within the table 2 and to inform the state within the table 2 to the engine driver.

In FIG. 19, a step S141 discriminates whether or not the paper jam is generated while transporting the paper within the duplex print unit 60. When the discrimination result in the step S141 is YES, a step S142 identifies the paper jam as a duplex unit jam. A step S143 discriminates whether or not the paper jam is generated while transporting the paper within the large capacity paper supply unit 5. When the discrimination result in the step S143 is YES, a step S144 identifies the paper jam as a paper supply unit jam. A step S145 discriminates whether or not the duplex unit jam exists. When the discrimination result in the step S145 is NO, a step S146 identifies the state as a state impossible to re-supply the paper from the duplex print unit 60. This is because even when there is no duplex unit jam, the duplex print unit 60 cannot re-supply the paper while there is the paper supply unit jam on the downstream side with respect to the paper which is to be re-supplied during the duplex print mode.

The process shown in FIG. 19 is ended when the discrimination result in the step S143 is NO, the discrimination result in the step S145 is YES, or after the step S146.

Figure 20:
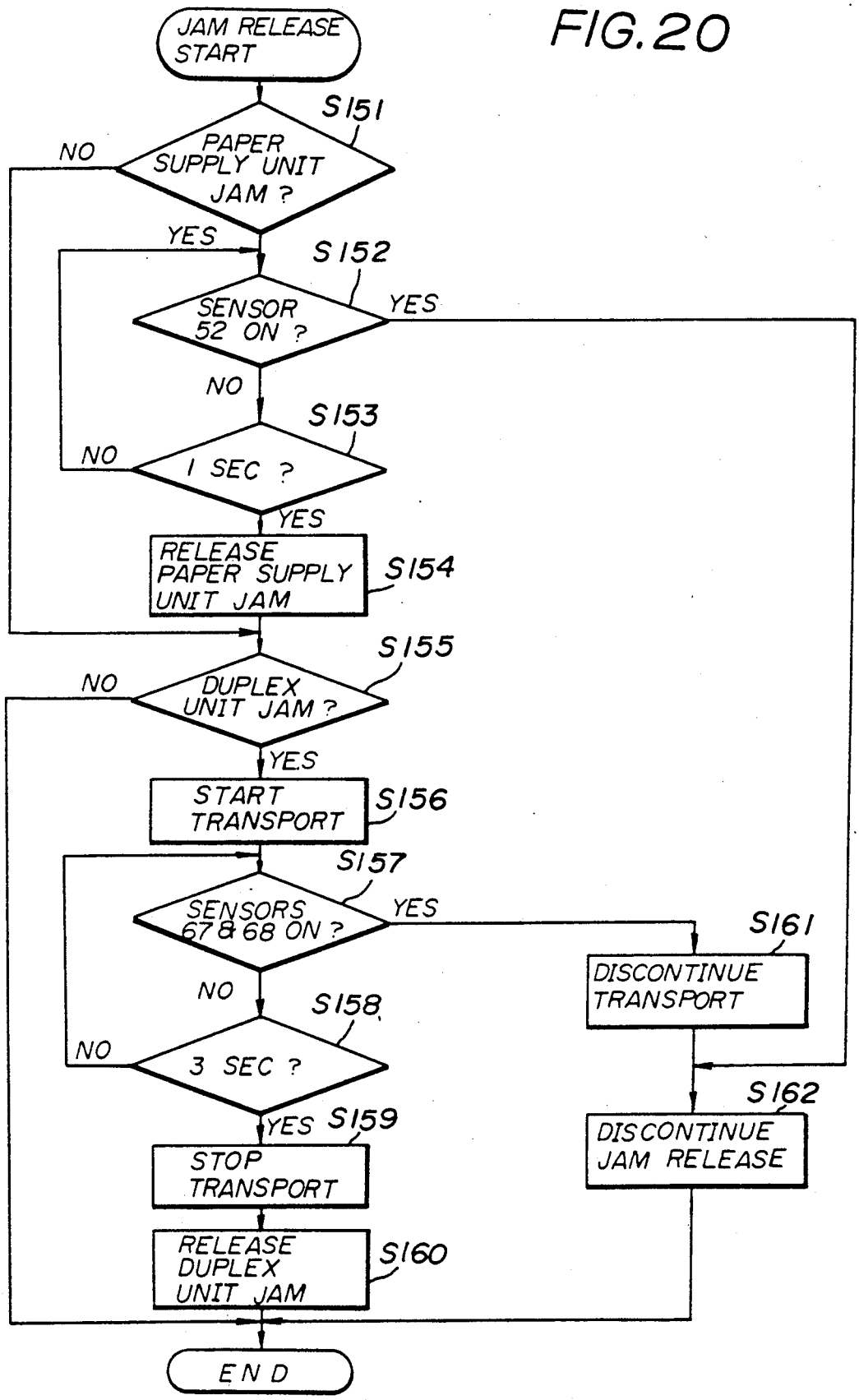

In this embodiment, the jam release operation is carried out as shown in FIG. 20. A step S151 discriminates whether or not the paper supply unit jam exists. When the discrimination result in the step S151 is YES, a step S152 discriminates whether or not the table exit sensor 52 is ON. When the discrimination result in the step S152 is NO, a step S153 discriminates whether or not one second has elapsed. The process returns to the step S152 when the discrimination result in the step S153 is NO. A step S154 releases the paper supply unit jam when the discrimination result in the step S153 is YES. In other words, the paper supply unit jam is released when the OFF state of the table exit sensor 52 continues for one second.

A step S155 discriminates whether or not the duplex unit jam exists when the discrimination result in the step S151 is NO or after the step S154. When the discrimination result in the step S155 is YES, a step S156 starts the paper transport operation of the duplex print unit 60. A step S157 discriminates whether or not the duplex unit entrance sensor 67 and the duplex unit exit sensor 68 are ON. When the discrimination result in the step S157 is NO, a step S158 discriminates whether or not three seconds has elapsed. The process returns to the step S157 when the discrimination result in the step S158 is NO. When the discrimination result in the step S158 is YES, a step S159 stops the paper transport operation of the duplex print unit 60 and a step S160 releases the duplex unit jam. In other words, the duplex unit jam is released when the OFF states of the duplex unit entrance sensor 67 and the duplex unit exit sensor 68 continue for three seconds.

On the other hand, when the discrimination result in the step S157 is YES, a step S161 discontinues the paper transport operation of the duplex print unit 60. When the discrimination result in the step S152 is YES or after the step S161, a step S162 discontinues the jam release.

The process is ended when the discrimination result in the step S155 is NO or after the step S160 or S162.

Accordingly, the jam release operation with respect to the duplex print unit 60 is carried out after the jam release operation is carried out with respect to the large capacity paper supply unit 5 which is on the downstream side of the paper transport path within the table 2. Hence, it is possible to carry out a control suited for a real time processing which by a simple program which requires only a small memory capacity. Hence, the possibility of errors being generated is small.

Even when the duplex unit jam and the paper supply unit jam occur, the paper supply unit jam is released in one second from the start of the jam release operation, thereby making it possible to immediately supply the paper from the large capacity paper supply unit 5 and make the one-sided print.

The duplex unit jam is released in three seconds from the start of the jam release operation, but when the supply of paper from the large capacity paper supply unit 5 precedes to make the one-sided print, the laser printer as a whole is operating during the three seconds and there is no deterioration of the performance of the laser printer.

The jam release operation is started responsive to an operation of closing the cover of the laser printer or responsive to a signal from the printer controller.

This embodiment is described by taking an example of a case where the paper jam occurs in the duplex print unit 60 and the large capacity paper supply unit 5 within the table 2. However, the present invention is not limited to this case and is similarly applicable to cases where the laser printer is provided with other paper supplying units and paper ejecting units in which the paper jam may occur. In such cases, it is also desirable that the jam release operation is carried out starting from the unit which is located on a most downstream side of the paper transport path.

The application of the present invention is of course not limited to the laser printer and is applicable to other image forming apparatuses including copying machines and facsimile machines.

Further, the present invention is not limited to these embodiments, but various variations and modifications may be made without departing from the scope of the present invention.

What is claimed is:

1. An image forming apparatus comprising:

one or a plurality of paper supply means for supplying sheets of paper;

image forming means for forming an image on a sheet of paper which is received from said paper supplying means;

ejecting means for ejecting sheets of paper which have images formed thereon by said image forming means;

one or a plurality of paper eject parts for receiving a sheet of paper which has an image formed thereon by said image forming means and is ejected by said ejecting means;

a plurality of paper transport paths comprising at least one paper transport path provided between said paper supply means and said image forming means, at least one paper transport path provided between said image forming means and said ejecting means and at least one paper transport bath provided between said ejecting means and said paper eject parts;

paper transport means for transporting the sheets of paper in said paper transport paths;

sequence control means for controlling a sequential operation of said paper supply means, said paper transport means, said image forming means and said ejecting means;

a plurality of paper detecting means for detecting an existence of paper at a plurality of positions in said paper transport paths, at least an arbitrary one of said paper detecting means constantly detecting the existence of paper;

transport abnormality detecting means for detecting a transport abnormality during the sequential operation based on output signals of said plurality of paper detecting means;

abnormality stop means for stopping the sequential operation when the transport abnormality is detected by said transport abnormality detecting means;

remaining paper counting means for counting a number of sheets of paper remaining within said paper transport paths during the sequential operation based on a difference between a number of sheets of paper supplied by said paper supply means and a number of sheets of paper ejected from said ejecting means; and remaining paper display means including a display for displaying the number of sheets of paper counted by said remaining paper counting means when the transport abnormality is detected by said transport abnormality detecting means.

2. The image forming apparatus as claimed in claim 1 which further comprises:

an engine driver which includes an input/output port, a central processing unit, timer means and memory means which are respectively coupled to each other via a bus;

said memory means storing data and programs for controlling said sequential operation;

said input/output port being coupled to said image forming means, said paper transport means, said paper detecting means and said remaining paper display means;

said central processing unit carrying out functions of at least said sequence control means, said transport abnormality detecting means, said abnormality stop means and said remaining paper counting means.

3. The image forming apparatus as claimed in claim 1 wherein said image forming means comprises a laser write unit.

4. The image forming apparatus as claimed in claim 1 which further comprises stop cancelling means for automatically cancelling a sequential operation stopping operation of said abnormality stop means when the output of said arbitrary paper detecting means changes from a signal indicating an existence of a sheet of paper to a signal indicating a non-existence of a sheet of paper during a stopped state of the sequential operation.

5. The image forming apparatus as claimed in claim 4 which further comprises an engine driver which includes an input/output port, a central processing unit, timer means and memory means which are respectively coupled to each other via a bus;

said memory means storing data and programs for controlling said sequential operation;

said input/output port being coupled to said image forming means, said paper transport means, said paper detecting means and said remaining paper display means;

said central processing unit carrying out functions of at least said sequence control means, said transport abnormality detecting means, said abnormality stop means, said remaining paper counting means and said stop cancelling means.

6. The image forming apparatus as claimed in claim 4 wherein said stop cancelling means successively carries out a cancelling operation in response to the outputs of said plurality of paper detecting means in a sequence starting from the output of said paper detecting means which is arranged in a paper transport path located on a most downstream side out of said paper transport paths along a direction in which the sheets of paper are transported from said paper supply means to said ejecting means.

7. The image forming apparatus as claimed in claim 1 wherein said transport abnormality is a paper jam.

8. An image forming apparatus comprising:

one or a plurality of paper supply means for supplying sheets of paper;

imaging forming means for forming an image on a sheet of paper which is received from said paper supplying means;

ejecting means for ejecting sheets of paper which have images formed thereon by said image forming means;

one or a plurality of paper eject parts for receiving a sheet of paper which has an image formed thereon by said image forming means and is ejected by said ejecting means;

a plurality of paper transport paths comprising at least one paper transport path provided between said paper supply means and said image forming means, at least one paper transport path and at least one paper transport path between said ejecting means and said paper eject parts;

paper transport means for transporting the sheets of paper in said paper transport paths;

sequence control means for controlling a sequential operation of said paper supply means, said paper transport means, said image forming means and said ejecting means;

a plurality of paper detecting means for detecting an existence of paper at a plurality of positions in said paper transport paths, at least an arbitrary one of said paper detecting means constantly detecting the existence of paper;

transport abnormality detecting means for detecting a transport abnormality during the sequential operation based on output signals of said plurality of paper detecting means;

abnormality stop means for stopping the sequential operation when the transport abnormality is detected by said transport abnormality detecting means;

abnormality stop means for automatically cancelling a sequential operation stopping operation of said abnormality stop means when the output of said arbitrary paper detecting means changes from a signal indicating an existence of a sheet of paper to a signal indicating a non-existence of a sheet of paper during a stopped state of the sequential operation.

9. The image forming apparatus as claimed in claim 8 which further comprises:

an engine driver which includes an input/output port, a central processing unit, timer means and memory means which are respectively coupled to each other via a bus;

said memory means storing data and programs for said sequential operation;

said input/output port being coupled to said image forming means, said paper transport means and said paper detecting means;

said central processing unit carrying out functions of at least said sequential control means, said transport abnormality detecting means, said abnormality stop means and said stop cancelling means.

10. The image forming apparatus as claimed in claim 8 wherein said stop cancelling means successively carries out a cancelling operation in response to the outputs of said plurality of paper detecting means in a sequence starting from the output of said paper detecting means which is arranged in a paper transport path located on a most downstream side out of said paper transport paths along a direction in which the sheets of paper are transported from said paper supply means to said ejecting means.

11. The image forming apparatus as claimed in claim 8 wherein said image forming means comprises a laser write unit.

12. The image forming apparatus as claimed in claim 8 wherein said transport abnormality is a paper jam.

* * * * *